US006608453B2

(12) United States Patent
Morgan et al.

(10) Patent No.: US 6,608,453 B2
(45) Date of Patent: Aug. 19, 2003

(54) METHODS AND APPARATUS FOR CONTROLLING DEVICES IN A NETWORKED LIGHTING SYSTEM

(75) Inventors: Frederick Morgan, Quincy, MA (US); Alfred Ducharme, Tewksbury, MA (US); Brian Chemel, Salem, MA (US); Robert Laszewski, Brookline, MA (US); Kevin Dowling, Westford, MA (US)

(73) Assignee: Color Kinetics Incorporated, Boston, MA (US)

( * ) Notice: Subject to any disclaimer, the term of this patent is extended or adjusted under 35 U.S.C. 154(b) by 0 days.

(21) Appl. No.: 09/870,193

(22) Filed: May 30, 2001

(65) Prior Publication Data

US 2002/0047628 A1 Apr. 25, 2002

Related U.S. Application Data

(63) Continuation-in-part of application No. 09/669,121, filed on Sep. 25, 2000, which is a continuation of application No. 09/425,770, filed on Oct. 22, 1999, now Pat. No. 6,150,774, which is a continuation of application No. 08/920,156, filed on Aug. 26, 1997, now Pat. No. 6,016,038, which is a continuation-in-part of application No. 09/215,624, filed on Dec. 17, 1998, and a continuation-in-part of application No. 09/213,607, filed on Dec. 17, 1998, and a continuation-in-part of application No. 09/213,189, filed on Dec. 17, 1998, and a continuation-in-part of application No. 09/213,581, filed on Dec. 17, 1998, and a continuation-in-part of application No. 09/213,540, filed on Dec. 17, 1998, which is a continuation-in-part of application No. 09/333,739, filed on Jun. 15, 1999, and a continuation-in-part of application No. 09/742,017, filed on Dec. 20, 2000, which is a continuation of application No. 09/213,548, filed on Dec. 17, 1998, now Pat. No. 6,166,496, and a continuation of application No. 09/815,418, filed on Mar. 22, 2001, which is a continuation of application No. 09/213,548.

(60) Provisional application No. 60/071,281, filed on Dec. 17, 1997, provisional application No. 60/068,792, filed on Dec. 24, 1997, provisional application No. 60/078,861, filed on Mar. 20, 1998, provisional application No. 60/079,285, filed on Mar. 25, 1998, and provisional application No. 60/090,920, filed on Jun. 26, 1998.

(51) Int. Cl.[7] ..... H05B 37/00

(52) U.S. Cl. ..... 315/312; 315/317; 315/318; 315/362; 315/297

(58) Field of Search ..... 315/291, 292, 315/295, 312, 316, 317, 318, 361, 362, 297, 307

(56) References Cited

U.S. PATENT DOCUMENTS 3,561,719 A 2/1971 Grindle (List continued on next page.)

FOREIGN PATENT DOCUMENTS

AU 6 267 9 12/1996

(List continued on next page.)

OTHER PUBLICATIONS

Co–pending U.S. patent application Ser. No. 10/158,579, (List continued on next page.)

*Primary Examiner*—Haissa Philogene
(74) *Attorney, Agent, or Firm*—Wolf, Greenfield & Sacks, P.C.

(57) ABSTRACT

Methods and apparatus for computer-based control of light sources and other devices in a networked lighting system. Conventional light sources may be controlled in combination with LED-based (e.g., variable color) light sources to provide enhanced lighting effects for a variety of space-illumination applications (e.g., residential, office/workplace, retail, commercial, industrial, and outdoor environments). Individual light sources or groups of light sources may be controlled independently of one another based on data transported throughout the network. In one example, one or more other controllable devices (e.g., various actuators, such as relays, switches, motors, etc.) and/or sensors (e.g., heat, light, sound/pressure, or motion sensors) also may be coupled to the network to facilitate automated lighting applications based on a variety of feedback stimuli.

156 Claims, 4 Drawing Sheets

U.S. PATENT DOCUMENTS

| | | | | |
|---|---|---|---|---|
| 3,643,088 | A | | 2/1972 | Osteen et al. |
| 3,746,918 | A | | 7/1973 | Drucker et al. |
| 3,832,503 | A | | 8/1974 | Crane |
| 3,858,086 | A | | 12/1974 | Anderson et al. |
| 3,909,670 | A | | 9/1975 | Wakamatsu et al. |
| 3,924,120 | A | | 12/1975 | Cox, III |
| 3,958,885 | A | | 5/1976 | Stockinger et al. |
| 3,974,637 | A | | 8/1976 | Bergey et al. |
| 4,001,571 | A | | 1/1977 | Martin |
| 4,054,814 | A | | 10/1977 | Fegley et al. |
| 4,082,395 | A | | 4/1978 | Donato et al. |
| 4,096,349 | A | | 6/1978 | Donato |
| 4,213,182 | A | * | 7/1980 | Eichelberger et al. ..... 315/312 |
| 4,241,295 | A | | 12/1980 | Williams, Jr. |
| 4,272,689 | A | | 6/1981 | Crosby et al. |
| 4,273,999 | A | | 6/1981 | Pierpoint |
| 4,298,869 | A | | 11/1981 | Okuno |
| 4,329,625 | A | | 5/1982 | Nishizawa et al. |
| 4,367,464 | A | | 1/1983 | Kurahashi et al. |
| 4,388,567 | A | | 6/1983 | Yamazaki et al. |
| 4,388,589 | A | | 6/1983 | Molldrem, Jr. |
| 4,392,187 | A | | 7/1983 | Bornhorst |
| 4,420,711 | A | | 12/1983 | Takahashi et al. |
| 4,425,628 | A | * | 1/1984 | Bedard et al. ..... 710/8 |
| 4,500,796 | A | | 2/1985 | Quin |
| 4,625,152 | A | | 11/1986 | Nakai |
| 4,644,547 | A | * | 2/1987 | Vercellotti et al. ..... 709/236 |
| 4,647,217 | A | | 3/1987 | Havel |
| 4,656,398 | A | | 4/1987 | Michael et al. |
| 4,668,895 | A | | 5/1987 | Schneiter |
| 4,682,079 | A | | 7/1987 | Sanders et al. |
| 4,686,425 | A | | 8/1987 | Havel |
| 4,687,340 | A | | 8/1987 | Havel |
| 4,688,154 | A | | 8/1987 | Nilssen |
| 4,688,869 | A | | 8/1987 | Kelly |
| 4,695,769 | A | | 9/1987 | Schweickardt |
| 4,701,669 | A | | 10/1987 | Head et al. |
| 4,705,406 | A | | 11/1987 | Havel |
| 4,707,141 | A | | 11/1987 | Havel |
| 4,727,289 | A | | 2/1988 | Uchida |
| 4,740,882 | A | | 4/1988 | Miller |
| 4,771,274 | A | | 9/1988 | Havel |
| 4,780,621 | A | | 10/1988 | Bartleucci et al. |
| 4,818,072 | A | | 4/1989 | Mohebban |
| 4,837,565 | A | | 6/1989 | White |
| 4,845,481 | A | | 7/1989 | Havel |
| 4,845,745 | A | | 7/1989 | Havel |
| 4,863,223 | A | | 9/1989 | Weissenbach et al. |
| 4,874,320 | A | | 10/1989 | Freed et al. |
| 4,887,074 | A | | 12/1989 | Simon et al. |
| 4,922,154 | A | | 5/1990 | Cacoub |
| 4,934,852 | A | | 6/1990 | Havel |
| 4,965,561 | A | | 10/1990 | Havel |
| 4,973,835 | A | | 11/1990 | Kurosu et al. |
| 4,980,806 | A | | 12/1990 | Taylor et al. |
| 4,992,704 | A | | 2/1991 | Stinson |
| 5,003,227 | A | | 3/1991 | Nilssen |
| 5,008,595 | A | | 4/1991 | Kazar |
| 5,027,262 | A | | 6/1991 | Freed |
| 5,034,807 | A | | 7/1991 | Von Kohorn |
| 5,083,063 | A | | 1/1992 | Brooks |
| 5,126,634 | A | | 6/1992 | Johnson |
| 5,128,595 | A | | 7/1992 | Hara |
| 5,134,387 | A | | 7/1992 | Smith et al. |
| 5,142,199 | A | | 8/1992 | Elwell |
| 5,154,641 | A | | 10/1992 | McLaughlin |
| 5,164,715 | A | | 11/1992 | Kashiwabara et al. |
| 5,184,114 | A | | 2/1993 | Brown |
| 5,194,854 | A | | 3/1993 | Havel |
| 5,209,560 | A | | 5/1993 | Taylor et al. |
| 5,225,765 | A | | 7/1993 | Callahan et al. |
| 5,226,723 | A | | 7/1993 | Chen |
| 5,254,910 | A | | 10/1993 | Yang |
| 5,256,948 | A | | 10/1993 | Boldin et al. |
| 5,282,121 | A | | 1/1994 | Bornhorst et al. |
| 5,294,865 | A | | 3/1994 | Haraden |
| 5,329,431 | A | | 7/1994 | Taylor et al. |
| 5,350,977 | A | | 9/1994 | Hamamoto et al. |
| 5,357,170 | A | | 10/1994 | Luchaco et al. |
| 5,371,618 | A | | 12/1994 | Tai et al. |
| 5,374,876 | A | | 12/1994 | Horibata et al. |
| 5,388,357 | A | | 2/1995 | Malita |
| 5,392,431 | A | | 2/1995 | Pfisterer |
| 5,404,282 | A | | 4/1995 | Klinke et al. |
| 5,406,176 | A | | 4/1995 | Sugden |
| 5,410,328 | A | | 4/1995 | Yoksza et al. |
| 5,412,284 | A | | 5/1995 | Moore et al. |
| 5,420,482 | A | | 5/1995 | Phares |
| 5,432,408 | A | | 7/1995 | Matsuda et al. |
| 5,436,535 | A | | 7/1995 | Yang |
| 5,463,280 | A | | 10/1995 | Johnson |
| 5,465,144 | A | | 11/1995 | Parker et al. |
| 5,489,827 | A | | 2/1996 | Xia |
| 5,491,402 | A | | 2/1996 | Small |
| 5,504,395 | A | | 4/1996 | Johnson et al. |
| 5,545,950 | A | | 8/1996 | Cho |
| 5,559,681 | A | | 9/1996 | Duarte |
| 5,561,346 | A | | 10/1996 | Byrne |
| 5,575,459 | A | | 11/1996 | Anderson |
| 5,575,554 | A | | 11/1996 | Guritz |
| 5,592,051 | A | | 1/1997 | Korkala |
| 5,621,282 | A | | 4/1997 | Haskell |
| 5,640,061 | A | | 6/1997 | Bornhorst et al. |
| 5,701,058 | A | | 12/1997 | Roth |
| 5,721,471 | A | | 2/1998 | Begemann et al. |
| 5,751,118 | A | | 5/1998 | Mortimer |
| 5,752,766 | A | | 5/1998 | Bailey et al. |
| 5,769,527 | A | | 6/1998 | Taylor et al. |
| 5,803,579 | A | | 9/1998 | Turnbull et al. |
| 5,808,689 | A | | 9/1998 | Small |
| 5,821,695 | A | | 10/1998 | Vilanilam et al. |
| 5,852,658 | A | | 12/1998 | Knight et al. |
| RE36,030 | E | | 1/1999 | Nadeau |
| 5,859,508 | A | | 1/1999 | Ge et al. |
| 5,896,010 | A | | 4/1999 | Mikolajczak et al. |
| 5,912,653 | A | | 6/1999 | Fitch |
| 5,924,784 | A | | 7/1999 | Chliwnyj et al. |
| 5,946,209 | A | | 8/1999 | Eckel et al. |
| 5,952,680 | A | | 9/1999 | Strite |
| 5,959,547 | A | | 9/1999 | Tubel et al. |
| 5,962,992 | A | * | 10/1999 | Huang et al. ..... 315/294 |
| 5,963,185 | A | | 10/1999 | Havel |
| 5,974,553 | A | | 10/1999 | Gandar |
| 6,016,038 | A | | 1/2000 | Mueller et al. |
| 6,018,237 | A | | 1/2000 | Havel |
| 6,031,343 | A | | 2/2000 | Recknagel et al. |
| 6,072,280 | A | | 6/2000 | Allen |
| 6,132,072 | A | | 10/2000 | Turnbull et al. |
| 6,135,604 | A | | 10/2000 | Lin |
| 6,150,774 | A | | 11/2000 | Mueller et al. |
| 6,166,496 | A | | 12/2000 | Lys et al. |
| 6,175,201 | B1 | | 1/2001 | Sid |
| 6,183,086 | B1 | | 2/2001 | Neubert |
| 6,184,628 | B1 | | 2/2001 | Ruthenberg |
| 6,196,471 | B1 | | 3/2001 | Ruthenberg |
| 6,211,626 | B1 | | 4/2001 | Lys et al. |
| 6,215,409 | B1 | | 4/2001 | Blach |
| 6,250,774 | B1 | | 6/2001 | Begemann et al. |
| 6,292,901 | B1 | | 9/2001 | Lys et al. |
| 2001/0033488 | A1 | | 10/2001 | Chliwnyj, et al. |

FOREIGN PATENT DOCUMENTS

| | | | |
|---|---|---|---|
| CA | 2 178 432 | | 12/1996 |
| DE | 20018865 | U1 | 3/2001 |
| EP | 0534710 | B1 | 1/1996 |
| EP | 0752632 | A2 | 1/1997 |
| EP | 0752632 | A3 | 8/1997 |
| EP | 1020352 | A2 | 7/2000 |
| EP | 1113215 | A2 | 7/2001 |
| FR | 88 17359 | | 12/1998 |
| GB | 2176042 | A | 12/1986 |
| JP | 06043830 | | 2/1994 |
| JP | 8-106264 | | 4/1996 |
| JP | 08-00761 | | 12/1996 |
| JP | 9 320766 | | 12/1997 |
| WO | WO 89/05086 | | 6/1989 |
| WO | WO 94/18809 | | 8/1994 |
| WO | WO 95/13498 | | 5/1995 |
| WO | WO 96/41098 | | 12/1996 |

OTHER PUBLICATIONS filed May 30, 2002; Ihor Lys, et al., "Methods and Apparatus for Controlling Devices in a Networked Lighting System", Our Docket No. C01104/70096.

"LM117/LM317A/LM317 3—Terminal Adjustable Regulator", National Semiconductor Corporation, May 1997, pp. 1–20.

"DS96177 RS–422 Differential Bus Repeater", National Semiconductor Corporation, Feb. 1996, pp. 1–8.

"DS2003 / DA9667 / DS2004 High Current / Voltage Darlington Drivers", National Semiconductor Corporation, Dec. 1995, pp. 1–8.

"LM140A / LM140 / LM340A / LM7800C Series 3—Terminal Positive Regulators", National Semiconductor Corporation, Jan. 1995, pp. 1–14.

High End Systems, Inc., Trackspot User Manual Aug. 1997, Excerpts (Cover, Title page, pp. ii throught iii and 2–13 through 2–14).

Artistic License, AL4000 DMX512 Processors, Revision 3.4, Jun. 2000, Excerpts (Cover, pp. 7,92 through 102).

Artistic License, Miscellaneous Drawings (3 sheets) Jan. 12, 1995.

Artistic License, Miscellaneous Documents (2 sheets Feb. 1995 and Apr. 1996).

Co–Pending Application Ser. No. 09/663,969, filed Sep. 19, 2000, entitled "Universal Lighting Network Methods and Systems," our File No. C01104/70039.

Website Reference: Lamps & Gear Site, Announcing A New Industry Standard For Addressable Lighting Control Systems, 3 pages, Jul. 17, 2001.

* cited by examiner

METHODS AND APPARATUS FOR CONTROLLING DEVICES IN A NETWORKED LIGHTING SYSTEM

This application claims the benefit under 35 U.S.C. §120 as a continuation-in-part of U.S. application Ser. No. 09/669,421, filed Sep. 25, 2000, entitled MULTICOLORED LED LIGHTING METHODS AND APPARATUS, which is a continuation of U.S. Ser. No. 09/425,770, filed Oct. 22, 1999, now U.S. Pat. No. 6,150,774, which is a continuation of U.S. Ser. No, 08/920,156, filed Aug. 26, 1997, now U.S. Pat. No. 6,016,038.

This application also claims the benefit under 35 U.S.C. §120 as a continuation-in-part of the following U.S. non-provisional applications:

Ser. No. 09/215,624, filed Dec. 17, 1998, entitled SMART LIGHT BULB;

Ser. No. 09/213,607, filed Dec. 17, 1998, entitled SYSTEMS AND METHODS FOR SENSOR RESPONSIVE ILLUMINATION;

Ser. No. 09/213,189, filed Dec. 17, 1998, entitled PRECISION ILLUMINATION METHODS AND SYSTEMS;

Ser. No. 09/213,581, filed Dec. 17, 1998, entitled KINETIC ILLUMINATION SYSTEM AND METHODS;

Ser. No. 09/213,540, filed Dec. 17, 1998, entitled DATA DELIVERY TRACK.

This application also claims the benefit under 35 U.S.C. §120 as a continuation-in-part of the following U.S. non-provisional applications:

Ser. No. 09/333,739, filed Jun. 15, 1999, entitled DIFFUSE ILLUMINATION SYSTEMS AND METHODS;

Serial No. 09/742,017, filed Dec. 20, 2000, entitled "Lighting Entertainment System", which is a continuation of U.S. Ser. No. 09/213,548, filed Dec. 17. 1998, now U.S. Pat. No. 6,166,496; and Ser. No. 09/815,418, filed Mar. 22, 2001, entitled "Lighting Entertainment System", which also is a continuation of U.S. Ser. No. 09/213,548, filed Dec. 17, 1998, now U.S. Pat. No. 6,166,496.

This application also claims the benefit under 35 U.S.C. §120 of each of the following U.S. Provisional Applications, as at least one of the above-identified U.S. Non-provisional Applications similarly is entitled to the benefit of at least one of the following Provisional Applications:

Serial No. 60/071,281, filed Dec. 17, 1997, entitled "Digitally Controlled Light Emitting Diodes Systems and Methods";

Serial No. 60/068,792, filed Dec. 24, 1997, entitled "Multi-Color Intelligent Lighting";

Serial No. 60/078,861, filed Mar. 20, 1998, entitled "Digital Lighting Systems";

Serial No. 60/079,285, filed Mar. 25, 1998, entitled "System and Method for Controlled Illumination"; and Serial No. 60/090,920, filed Jun. 26, 1998, entitled "Methods for Software Driven Generation of Multiple Simultaneous High Speed Pulse Width Modulated Signals".

FIELD OF THE INVENTION

The present invention relates to lighting systems, and more particularly, to methods and apparatus for computer-based control of various light sources and other devices that may be coupled together to form a networked lighting system.

BACKGROUND

Conventional lighting for various space-illumination applications (e.g., residential, office/workplace, retail, commercial, industrial, and outdoor environments) generally involves light sources coupled to a source of power via manually operated mechanical switches. Some examples of conventional lighting include fluorescent, incandescent, sodium and halogen light sources. Incandescent light sources (e.g., tungsten filament light bulbs) are perhaps most commonly found in residential environments, while fluorescent light sources (e.g., ballast-controlled gas discharge tubes) commonly are used for large lighting installations in office and workplace environments, due to the high efficiency (high intensity per unit power consumed) of such sources. Sodium light sources commonly are used in outdoor environments (e.g., street lighting), and are also recognized for their energy efficiency, whereas halogen light sources may be found in residential and retail environments as more efficient alternatives to incandescent light sources.

Unlike the foregoing lighting examples, light emitting diodes (LEDs) are semiconductor-based light sources often employed in low-power instrumentation and appliance applications for indication purposes. LEDs conventionally are available in a variety of colors (e.g., red, green, yellow, blue, white), based on the types of materials used in their fabrication. This color variety of LEDs recently has been exploited to create novel LED-based light sources having sufficient light output for new space-illumination applications. For example, as discussed in U.S. Pat. No. 6,016,038, multiple differently colored LEDs may be combined in a lighting fixture, wherein the intensity of the LEDs of each different color is independently varied to produce a number of different hues. In one example of such an apparatus, red, green, and blue LEDs are used in combination to produce literally hundreds of different hues from a single lighting fixture. Additionally, the relative intensities of the red, green, and blue LEDs may be computer controlled, thereby providing a programmable multi-color light source. Such LED-based light sources have been employed in a variety of lighting applications in which variable color lighting effects are desired.

SUMMARY OF THE INVENTION

One embodiment of the invention is directed to a method, comprising acts of: A) transmitting data to an independently addressable controller coupled to at least one LED light source and at least one other controllable device, the data including at least one of first control information for a first control signal output by the controller to the at least one LED light source and second control information for a second control signal output by the controller to the at least one other controllable device, and B) controlling at least one of the at least one LED light source and the at least one other controllable device based on the data.

Another embodiment of the invention is directed to a method, comprising acts of: A) receiving data for a plurality of independently addressable controllers, at least one independently addressable controller of the plurality of independently addressable controllers coupled to at least one LED light source and at least one other controllable device, B) selecting at least a portion of the data corresponding to at least one of first control information for a first control signal output by the at least one independently addressable controller to the at least one LED light source and second control information for a second control signal output by the at least one independently addressable controller to the at least one other controllable device, and C) controlling at least one of the at least one LED light source and the at least one other controllable device based on the selected portion of the data.

Another embodiment of the invention is directed to a lighting system, comprising a plurality of independently addressable controllers coupled together to form a network, at least one independently addressable controller of the plurality of independently addressable controllers coupled to at least one LED light source and at least one other controllable device, and at least one processor coupled to the network and programmed to transmit data to the plurality of independently addressable controllers, the data corresponding to at least one of first control information for a first control signal output by the at least one independently addressable controller to the at least one LED light source and second control information for a second control signal output by the at least one independently addressable controller to the at least one other controllable device.

Another embodiment of the invention is directed to an apparatus for use in a lighting system including a plurality of independently addressable controllers coupled together to form a network, at least one independently addressable controller of the plurality of independently addressable controllers coupled to at least one LED light source and at least one other controllable device. The apparatus comprises at least one processor having an output to couple the at least one processor to the network, the at least one processor programmed to transmit data to the plurality of independently addressable controllers, the data corresponding to at least one of first control information for a first control signal output by the at least one independently addressable controller to the at least one LED light source and second control information for a second control signal output by the at least one independently addressable controller to the at least one other controllable device.

Another embodiment of the invention is directed to an apparatus for use in a lighting system including at least one LED light source and at least one other controllable device. The apparatus comprises at least one controller having at least first and second output ports to couple the at least one controller to at least the at least one LED light source and the at least one other controllable device, respectively, the at least one controller also having at least one data port to receive data including at least one of first control information for a first control signal output by the first output port to the at least one LED light source and second control information for a second control signal output by the second output port to the at least one other controllable device, the at least one controller constructed to control at least one of the at least one LED light source and the at least one other controllable device based on the data.

Another embodiment of the invention is directed to a method in a lighting system including at least first and second independently addressable devices coupled to form a series connection, at least one device of the independently addressable devices including at least one light source. The method comprises an act of: A) transmitting data to at least the first and second independently addressable devices, the data including control information for at least one of the first and second independently addressable devices, the data being arranged based on a relative position in the series connection of at least the first and second independently addressable devices.

Another embodiment of the invention is directed to a method in a lighting system including at least first and second independently addressable devices, at least one device of the independently addressable devices including at least one light source. The method comprises acts of: A) receiving at the first independently addressable device first data for at least the first and second independently addressable devices, B) removing at least a first data portion from the first data to form second data, the first data portion corresponding to first control information for the first independently addressable device. and C) transmitting from the first independently addressable device the second data.

Another embodiment of the invention is directed to a lighting system, comprising at least first and second independently addressable devices coupled to form a series connection, at least one device of the independently addressable devices including at least one light source, and at least one processor coupled to the first and second independently addressable devices, the at least one processor programmed to transmit data to at least the first and second independently addressable devices, the data including control information for at least one of the first and second independently addressable devices, the data arranged based on a relative position in the series connection of at least the first and second independently addressable devices.

Another embodiment of the invention is directed to an apparatus for use in a lighting system including at least first and second independently addressable devices coupled to form a series connection, at least one device of the independently addressable devices including at least one light source. The apparatus comprises at least one processor having an output to couple the at least one processor to the first and second independently addressable devices, the at least one processor programmed to transmit data to at least the first and second independently addressable devices, the data including control information for at least one of the first and second independently addressable devices, the data arranged based on a relative position in the series connection of at least the first and second independently addressable devices.

Another embodiment of the invention is directed to an apparatus for use in a lighting system including at least first and second independently controllable devices, at least one device of the independently controllable devices including at least one light source. The apparatus comprises at least one controller having at least one output port to couple the at least one controller to at least the first independently controllable device and at least one data port to receive first data for at least the first and second independently controllable devices, the at least one controller constructed to remove at least a first data portion from the first data to form second data and to transmit the second data via the at least one data port, the first data portion corresponding to first control information for at least the first independently controllable device.

DETAILED DESCRIPTION

Figure 1:
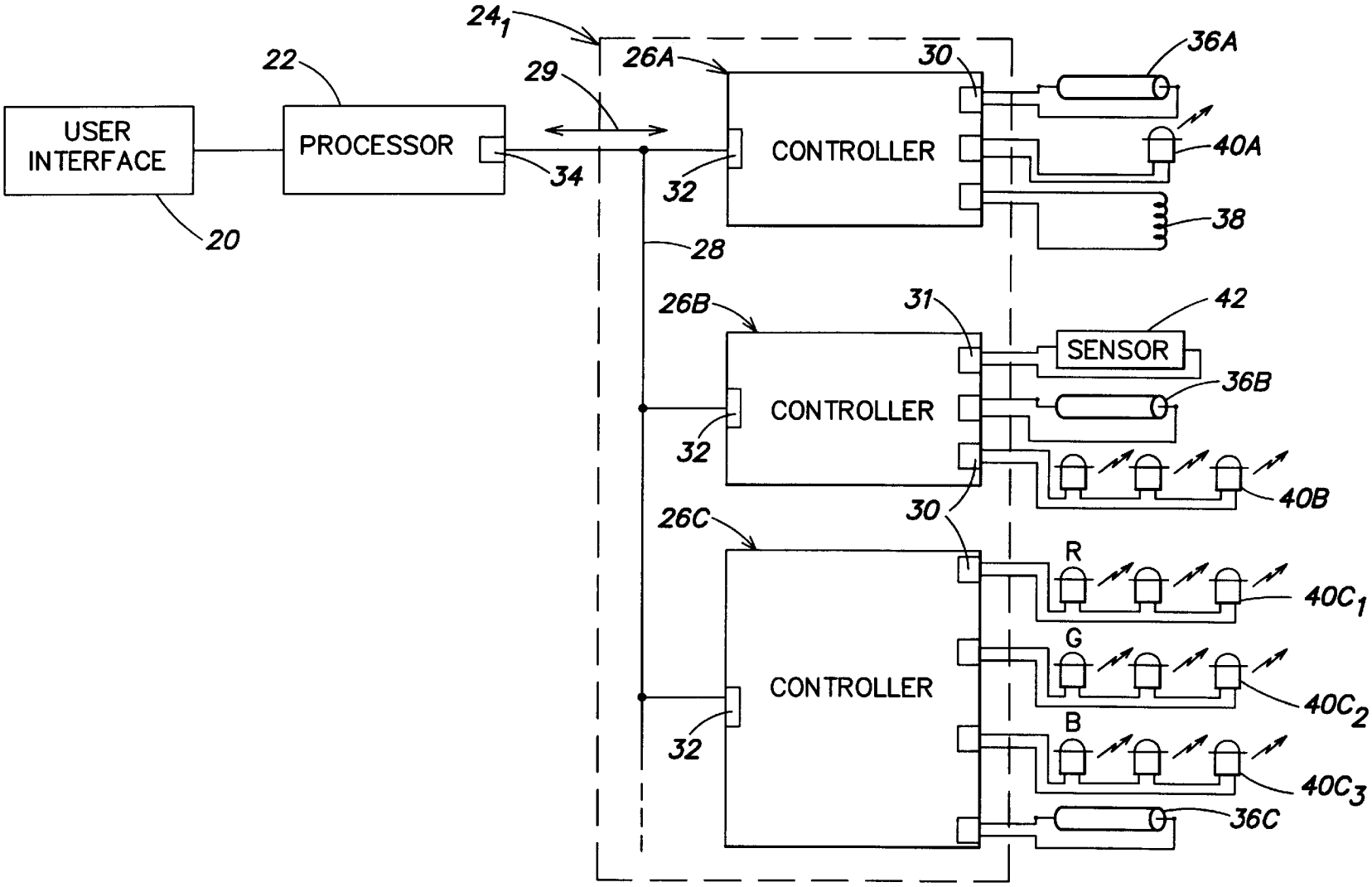
FIG. 1 is a diagram showing a networked lighting system according to one embodiment of the invention.

Applicant has appreciated that by combining conventional light sources (e.g., fluorescent and incandescent light sources) with LED-based (e.g., variable color) light sources, a variety of enhanced lighting effects may be realized for a number of space-illumination applications (e.g., residential, office/workplace, retail, commercial, industrial, and outdoor environments). Applicant also has recognized that various light sources and other devices may be integrated together in a microprocessor-based networked lighting system to provide a variety of computer controlled programmable lighting effects.

Accordingly, one embodiment of the present invention is directed generally to networked lighting systems, and to various methods and apparatus for computer-based control of various light sources and other devices that may be coupled together to form a networked lighting system. In one aspect of the invention, conventional light sources are employed in combination with LED-based (e.g., variable color) light sources to realize enhanced lighting effects. For example, in one embodiment, one or more computer-controllable (e.g., microprocessor-based) light sources conventionally used in various space-illumination applications and LED-based light sources are combined in a single fixture (hereinafter, a "combined" fixture), wherein the conventional light sources and the LED-based sources may be controlled independently. In another embodiment, dedicated computer-controllable light fixtures including conventional space-illumination light sources and LED-based light fixtures, as well as combined fixtures, may be distributed throughout a space and coupled together as a network to facilitate computer control of the fixtures.

In one embodiment of the invention, controllers (which may, for example, be microprocessor-based) are associated with both LED-based light sources and conventional light sources (e.g., fluorescent light sources) such that the light sources are independently controllable. More specifically, according to one embodiment, individual light sources or groups of light sources are coupled to independently controllable output ports of one or more controllers, and a number of such controllers may in turn be coupled together in various configurations to form a networked lighting system. According to one aspect of this embodiment, each controller coupled to form the networked lighting system is "independently addressable," in that it may receive data for multiple controllers coupled to the network, but selectively responds to data intended for one or more light sources coupled to it. By virtue of the independently addressable controllers, individual light sources or groups of light sources coupled to the same controller or to different controllers may be controlled independently of one another based on various control information (e.g., data) transported throughout the network. In one aspect of this embodiment, one or more other controllable devices (e.g., various actuators, such as relays, switches, motors, etc.) also may be coupled to output ports of one or more controllers and independently controlled.

According to one embodiment, a networked lighting system may be an essentially one-way system, in that data is transmitted to one or more independently addressable controllers to control various light sources and/or other devices via one or more output ports of the controllers. In another embodiment, controllers also may have one or more independently identifiable input ports to receive information (e.g., from an output of a sensor) that may be accessed via the network and used for various control purposes. In this aspect, the networked lighting system may be considered as a two-way system, in that data is both transmitted to and received from one or more independently addressable controllers. It should be appreciated, however, that depending on a given network topology (i.e., interconnection of multiple controllers) as discussed further below, according to one embodiment, a controller may both transmit and receive data on the network regardless of the particular configuration of its ports.

In sum, a lighting system controller according to one embodiment of the invention may include one or more independently controllable output ports to provide control signals to light sources or other devices, based on data received by the controller. The controller output ports are independently controllable in that each controller receiving data on a network selectively responds to and appropriately routes particular portions of the data intended for that controller's output ports. In one aspect of this embodiment, a lighting system controller also may include one or more independently identifiable input ports to receive output signals from various sensors (e.g., light sensors, sound or pressure sensors, heat sensors, motion sensors); the input ports are independently identifiable in that the information obtained from these ports may be encoded by the controller as particularly identifiable data on the network. In yet another aspect, the controller is "independently addressable," in that the controller may receive data intended for multiple controllers coupled to the network, but selectively exchanges data with (i.e., receives data from and/or transmits data to) the network based on the one or more input and/or output ports it supports.

According to one embodiment of the invention in which one or more sensors are employed, a networked lighting system may be implemented to facilitate automated computer-controlled operation of multiple light sources and devices in response to various feedback stimuli, for a variety of space-illumination applications. For example, automated lighting applications for home, office, retail environments and the like may be implemented based on a variety of feedback stimuli (e.g., changes in temperature or natural ambient lighting, sound or music, human movement or other motion, etc.).

According to various embodiments, multiple controllers may be coupled together in a number of different configurations (i.e., topologies) to form a networked lighting system. For example, according to one embodiment, data including control information for multiple light sources (and optionally other devices), as well as data corresponding to information received from one or more sensors, may be transported throughout the network between one or more central or "hub" processors, and multiple controllers each coupled to one or more light sources, other controllable devices, and/or sensors. In another embodiment, a network of multiple controllers may not include a central hub processor exchanging information with the controllers; rather, the controllers may be coupled together to exchange information with each other in a de-centralized manner.

More generally, in various embodiments, a number of different network topologies, data protocols, and addressing schemes may be employed in networked lighting systems according to the present invention. For example, according to one embodiment, one or more particular controller addresses may be manually pre-assigned to each controller on the network (e.g., stored in nonvolatile memory of the controller). Alternatively, the system may be "self-learning" in that one or more central processors (e.g., servers) may query (i.e., "ping") for the existence of controllers (e.g., clients) coupled to the network, and assign one or more addresses to controllers once their existence is verified. In these embodiments, a variety of addressing schemes and data protocols may be employed, including conventional Internet addressing schemes and data protocols.

In yet other embodiments, a particular network topology may dictate an addressing scheme and/or data protocol for the networked lighting system. For example, in one embodiment, addresses may be assigned to respective controllers on the network based on a given network topology and a particular position in the network topology of respective controllers. Similarly, in another embodiment, data may be arranged in a particular manner (e.g., a particular sequence) for transmission throughout the network based on a particular position in the network topology of respective controllers. In one aspect of this embodiment, the network may be considered "self-configuring" in that it does not require the specific assignment of addresses to controllers, as the position of controllers relative to one another in the network topology dictates the data each controller exchanges with the network.

In particular, according to one embodiment, data ports of multiple controllers are coupled to form a series connection (e.g., a daisy-chain or ring topology for the network), and data transmitted to the controllers is arranged sequentially based on a relative position in the series connection of each controller. In one aspect of this embodiment, as each controller in the series connection receives data, it "strips off" one or more initial portions of the data sequence intended for it and transmits the remainder of the data sequence to the next controller in the series connection. Each controller on the network in turn repeats this procedure, namely, stripping off one or more initial portions of a received data sequence and transmitting the remainder of the sequence. Such a network topology obviates the need for assigning one or more specific addresses to each controller; as a result, each controller may be configured similarly, and controllers may be flexibly interchanged on the network or added to the network without requiring a system operator or network administrator to reassign addresses.

Following below are more detailed descriptions of various concepts related to, and embodiments of, methods and apparatus according to the present invention for controlling devices in a networked lighting system. It should be appreciated that various aspects of the invention, as discussed above and outlined further below, may be implemented in any of numerous ways, as the invention is not limited to any particular manner of implementation. Examples of specific implementations are provided for illustrative purposes only.

FIG. 1 is a diagram illustrating a networked lighting system according to one embodiment of the invention. In the system of FIG. 1, three controllers 26A, 26B and 26C are coupled together to form a network $\mathbf{24}_1$. In particular, each of the controllers 26A, 26B and 26C has a data port 32 through which data 29 is exchanged between the controller and at least one other device coupled to the network. While FIG. 1 shows a network including three controllers, it should be appreciated that the invention is not limited in this respect, as any number of controllers may be coupled together to form the network $\mathbf{24}_1$.

FIG. 1 also shows a processor 22 coupled to the network $\mathbf{24}_1$ via an output port 34 of the processor. In one aspect of the embodiment shown in FIG. 1, the processor 22 also may be coupled to a user interface 20 to allow system operators or network administrators to access the network (e.g., transmit information to and/or receive information from one or more of the controllers 26A, 26B, and 26C, program the processor 22, etc.).

The networked lighting system shown in FIG. 1 is configured essentially using a bus topology; namely, each of the controllers is coupled to a common bus 28. However, it should be appreciated that the invention is not limited in this respect, as other types of network topologies (e.g., tree, star, daisy-chain or ring topologies) may be implemented according to other embodiments of the invention. In particular, an example of a daisy-chain or ring topology for a networked lighting system according to one embodiment of the invention is discussed further below in connection with FIG. 3. Also, it should be appreciated that the network lighting system illustrated in FIG. 1 may employ any of a variety of different addressing schemes and data protocols to transfer data 29 between the processor 22 and one or more controllers 26A, 26B, and 26C, or amongst the controllers. Some examples of addressing schemes and data protocols suitable for purposes of the present invention are discussed in greater detail below.

As also illustrated in the embodiment of FIG. 1, each controller 26A, 26B, and 26C of the networked lighting system is coupled to one or more of a variety of devices, including, but not limited to, conventional light sources (e.g., fluorescent or incandescent lights), LED-based light sources, controllable actuators (e.g., switches, relays, motors, etc.), and various sensors (e.g., light, heat, sound/pressure, motion sensors). For example, FIG. 1 shows that the controller 26A is coupled to a fluorescent light 36A, an LED 40A, and a controllable relay 38; similarly, the controller 26B is coupled to a sensor 42, a fluorescent light source 36B, and a group 40B of three LEDs, and the controller 26C is coupled to three groups $\mathbf{40}C_1$, $\mathbf{40}C_2$, and $\mathbf{40}C_3$ of LEDs, as well as a fluorescent light source 36C.

The fluorescent light sources illustrated in FIG. 1 (and in other figures) are shown schematically as simple tubes; however, it should be appreciated that this depiction is for purposes of illustration only. In particular, the gas discharge tube of a fluorescent light source typically is controlled by a ballast (not shown in the figures) which receives a control signal (e.g., a current or voltage) to operate the light source. For purposes of this disclosure, fluorescent light sources generally are understood to comprise a glass tube filled with a vapor, wherein the glass tube has an inner wall that is coated with a fluorescent material. Fluorescent light sources emit light by controlling a ballast electrically coupled to the glass tube to pass an electrical current through the vapor in the tube. The current passing through the vapor causes the vapor to discharge electrons, which in turn impinge upon the fluorescent material on the wall of the tube and cause it to glow (i.e., emit light). One example of a conventional fluorescent light ballast may be controlled by applying an AC voltage (e.g., 120 Volts AC) to the ballast to cause the glass tube to emit light. In another example of a conventional fluorescent light ballast, a DC voltage between 0 and 10 Volts DC may be applied to the ballast to incrementally control the amount of light (e.g., intensity) radiated by the glass tube.

In the embodiment of FIG. 1, it should be appreciated generally that the particular types and configuration of various devices coupled to the controllers 26A, 26B, and 26C is for purposes of illustration only, and that the invention is not limited to the particular configuration shown in FIG. 1. For example, according to other embodiments, a given controller may be associated with only one device, another controller may be associated with only output devices (e.g., one or more light sources or actuators), another controller may be associated with only input devices (e.g., one or more sensors), and another controller may be associated with any number of either input or output devices, or combinations of input and output devices. Additionally, different implementations of a networked lighting system according to the invention may include only light sources, light sources and other output devices, light sources and sensors, or any combination of light sources, other output devices, and sensors.

As shown in FIG. 1, according to one embodiment, the various devices are coupled to the controllers 26A, 26B, and 26C via a number of ports. More specifically, in addition to at least one data port 32, each controller may include one or more independently controllable output ports 30 as well as one or more independently identifiable input ports 31. According to one aspect of this embodiment, each output port 30 provides a control signal to one or more devices coupled to the output port 30, based on particular data received by the controller via the data port 32. Similarly, each input port 31 receives a signal from one or more sensors, for example, which the controller then encodes as data which may be transmitted via the data port 32 throughout the network and identified as corresponding to a signal received at a particular input port of the network.

In particular, according to one aspect of this embodiment, particular identifiers may be assigned to each output port and input port of a given controller. This may be accomplished, for example, via software or firmware at the controller (e.g., stored in the memory 48), a particular hardware configuration of the various input and/or output ports, instructions received via the network (i.e., the data port 32) from the processor 22 or one or more other controllers, or any combination of the foregoing. In another aspect of this embodiment, the controller is independently addressable in that the controller may receive data intended for multiple devices coupled to output ports of other controllers on the network, but has the capability of selecting and responding to (i.e., selectively routing) particular data to one or more of its output ports, based on the relative configuration of the ports (e.g., assignment of identifiers to ports and/or physical arrangement of ports) in the controller. Furthermore, the controller is capable of transmitting data to the network that is identifiable as corresponding to a particular input signal received at one or more of its input ports 31.

For example, in one embodiment of the invention based on the networked lighting system shown in FIG. 1, a sensor 42 responsive to some input stimulus (e.g., light, sound/pressure, temperature, motion, etc.) provides a signal to an input port 31 of the controller 26B, which may be particularly accessed (i.e., independently addressed) over the network $\mathbf{24}_1$ (e.g., by the processor 22) via the data port 32 of the controller 26B. In response to signals output by the sensor 42, the processor 22 may transmit various data throughout the network, including control information to control one or more particular light sources and/or other devices coupled to any one of the controllers 26A, 26B, and 26C; the controllers in turn each receive the data, and selectively route portions of the data to appropriate output ports to effect the desired control of particular light sources and/or other devices. In another embodiment of the invention not employing the processor 22, but instead comprising a de-centralized network of multiple controllers coupled together, any one of the controllers may function similarly to the processor 22, as discussed above, to first access input data from one or more sensors and then implement various control functions based on the input data.

From the foregoing, it should be appreciated that a networked lighting system according to one embodiment of the invention may be implemented to facilitate automated computer-controlled operation of multiple light sources and devices in response to various feedback stimuli (e.g., from one or more sensors coupled to one or more controllers of the network), for a variety of space-illumination applications. For example, automated networked lighting applications according to the invention for home, office, retail, commercial environments and the like may be implemented based on a variety of feedback stimuli (e.g., changes in temperature or natural ambient lighting, sound or music, human movement or other motion, etc.) for energy management and conservation, safety, marketing and advertisement, entertainment and environment enhancement, and a variety of other purposes.

In different embodiments based on the system of FIG. 1, various data protocols and addressing schemes may be employed in networked lighting systems according to the invention. For example, according to one embodiment, particular controller and/or controller output and input port addresses may be manually pre-assigned to each controller on the network $\mathbf{24}_1$ (e.g., stored in nonvolatile memory of the controller). Alternatively, the system may be "self-configuring" in that the processor 22 may query (i.e., "ping") for the existence of controllers coupled to the network $\mathbf{24}_1$, and assign addresses to controllers once their existence is verified. In these embodiments, a variety of addressing schemes and data protocols may be employed, including conventional Internet addressing schemes and data protocols. The foregoing concepts also may be applied to the embodiment of a networked lighting system shown in FIG. 3, discussed in greater detail below.

According to one embodiment of the invention, differently colored LEDs may be combined along with one or more conventional non-LED light sources, such as one or more fluorescent light sources, in a computer-controllable lighting fixture (e.g., a microprocessor-based lighting fixture). In one aspect of this embodiment, the different types of light sources in such a fixture may be controlled independently, either in response to some input stimulus or as a result of particularly programmed instructions, to provide a variety of enhanced lighting effects for various applications. The use of differently colored LEDs (e.g., red, green, and blue) in microprocessor-controlled LED-based light sources is discussed, for example, in U.S. Pat. No. 6,016,038, hereby incorporated herein by reference. In these LED-based light sources, generally an intensity of each LED color is independently controlled by programmable instructions so as to provide a variety of colored lighting effects. According to one embodiment of the present invention, these concepts are further extended to implement microprocessor-based control of a lighting fixture including both conventional non-LED light sources and novel LED-based light sources.

For example, as shown in FIG. 1, according to one embodiment of the invention, the controller 26C is coupled to a first group $\mathbf{40}C_1$ of red LEDs, a second group $\mathbf{40}C_2$ of green LEDs, and a third group $\mathbf{40}C_3$ of blue LEDs. Each of the first, second, and third groups of LEDs is coupled to a respective independently controllable output port 30 of the controller 26C, and accordingly may be independently controlled. Although three LEDs connected in series are shown in each illustrated group of LEDs in FIG. 1, it should be appreciated that the invention is not limited in this respect; namely, any number of light sources or LEDs may be coupled together in a series or parallel configuration and controlled by a given output port 30 of a controller, according to various embodiments.

The controller 26C shown in FIG. 1 also is coupled to a fluorescent light source 36C via another independently controllable output port 30. According to one embodiment, data received and selectively routed by the controller 26C to its respective output ports includes control information corresponding to desired parameters (e.g., intensity) for each of the red LEDs 40$C_1$, the green LEDs 40$C_2$, the blue LEDs 40$C_3$, and the fluorescent light source 36C. In this manner, the intensity of the fluorescent light source 36C may be independently controlled by particular control information (e.g., microprocessor-based instructions), and the relative intensities of the red, green, and blue LEDs also may be independently controlled by respective particular control information (e.g., microprocessor-based instructions), to realize a variety of color enhancement effects for the fluorescent light source 36C.

Figure 2:
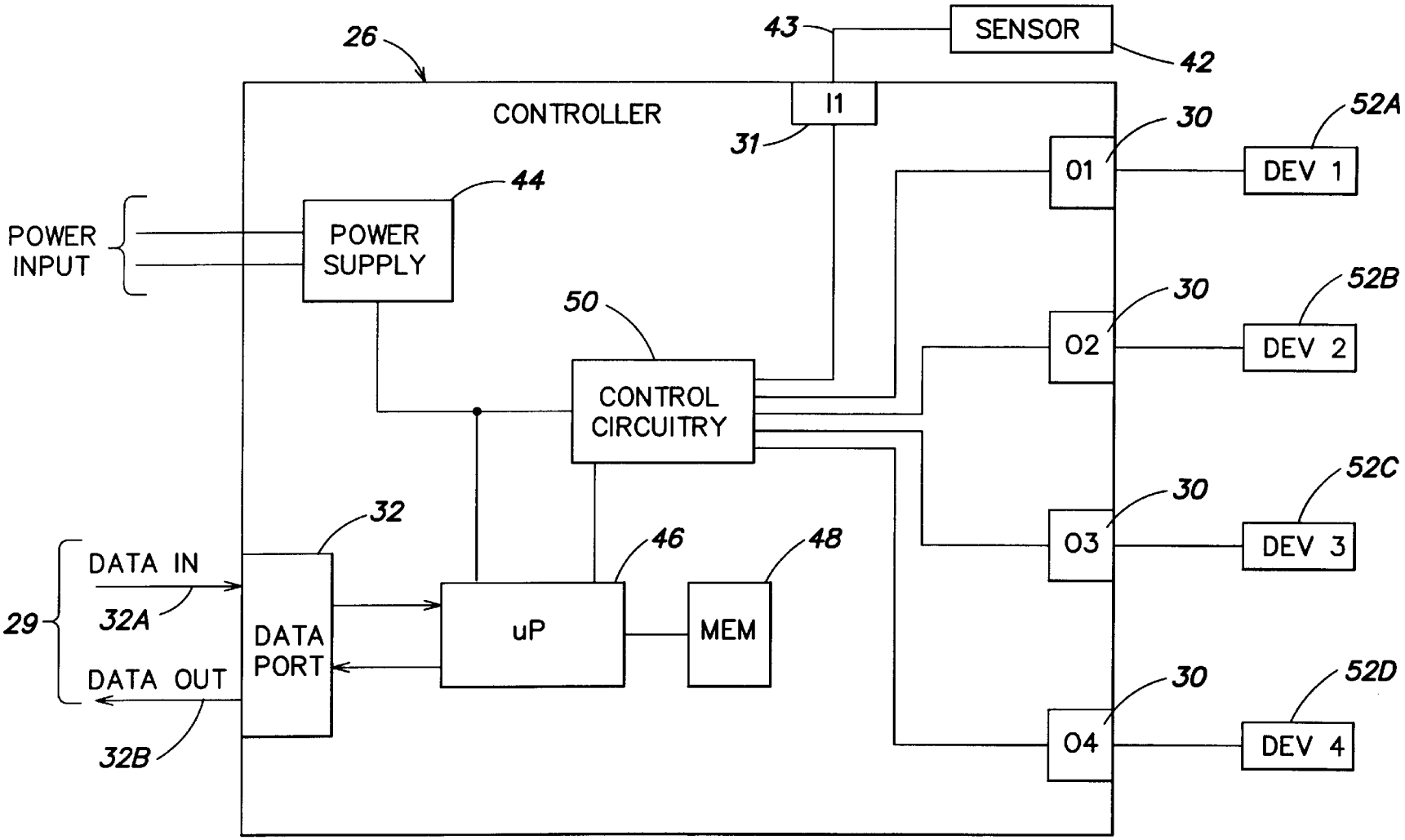
FIG. 2 is a diagram showing an example of a controller in the lighting system of FIG. 1, according to one embodiment of the invention.

FIG. 2 is a diagram illustrating an example of a controller 26, according to one embodiment of the invention, that may be employed as any one of the controllers 26A, 26B, and 26C in the networked lighting of FIG. 1. As shown in FIG. 2, the controller 26 includes a data port 32 having an input terminal 32A and an output terminal 32B, through which data 29 is transported to and from the controller 26. The controller 26 of FIG. 2 also includes a microprocessor 46 ($\mu$P) to process the data 29, and may also include a memory 48 (e.g., volatile and/or non-volatile memory).

The controller 26 of FIG. 2 also includes control circuitry 50, coupled to a power supply 44 and the microprocessor 46. The control circuitry 50 and the microprocessor 46 operate so as to appropriately transmit various control signals from one or more independently controllable output ports 30 (indicated as O1, O2, O3, and O4 in FIG. 2), based on data received by the microprocessor 46. While FIG. 2 illustrates four output ports 30, it should be appreciated that the invention is not limited in this respect, as the controller 26 may be designed to have any number of output ports. The power supply 44 provides power to the microprocessor 46 and the control circuitry 50, and ultimately may be employed to drive the control signals output by the output ports, as discussed further below.

According to one embodiment of the invention, the microprocessor 46 shown in FIG. 2 is programmed to decode or extract particular portions of the data it receives via the data port 32 that correspond to desired parameters for one or more devices 52A–52D (indicated as DEV1, DEV2, DEV3, and DEV4 in FIG. 2) coupled to one or more output ports 30 of the controller 26. As discussed above in connection with FIG. 1, the devices 52A–52D may be individual light sources, groups of lights sources, or one or more other controllable devices (e.g., various actuators). In one aspect of this embodiment, once the microprocessor 46 decodes or extracts particular portions of the received data intended for one or more output ports of the controller 26, the decoded or extracted data portions are transmitted to the control circuitry 50, which converts the data portions to control signals output by the one or more output ports.

In one embodiment, the control circuitry 50 of the controller 26 shown in FIG. 2 may include one or more digital-to-analog converters (not shown in the figure) to convert data portions received from the microprocessor 46 to analog voltage or current output signals provided by the output ports. In one aspect of this embodiment, each output port may be associated with a respective digital-to-analog converter of the control circuitry, and the control circuitry 50 may route respective data portions received from the microprocessor 46 to the appropriate digital-to-analog converters. As discussed above, the power supply 44 may provide power to the digital-to-analog converters so as to drive the analog output signals. In one aspect of this embodiment, each output port 30 may be controlled to provide a variable analog voltage control signal in a range of from 0 to 10 Volts DC. It should be appreciated, however, that the invention is not limited in this respect; namely, other types of control signals may be provided by one or more output ports of a controller, or different output ports of a controller may be configured to provide different types of control signals, according to other embodiments.

For example, according to one embodiment, the control circuitry 50 of the controller 26 shown in FIG. 2 may provide pulse width modulated signals as control signals at one or more of the output ports 30. In this embodiment, it should be appreciated that, according to various possible implementations, digital-to-analog converters as discussed above may not necessarily be employed in the control circuitry 50. The use of pulse width modulated signals to drive respective groups of differently colored LEDs in LED-based light sources is discussed for example, in U.S. Pat. No. 6,016,038, referenced above. According to one embodiment of the present invention, this concept may be extended to control other types of light sources and/or other controllable devices of a networked lighting system.

As shown in FIG. 2, the controller 26 also may include one or more independently identifiable input ports 31 coupled to the control circuitry 50 to receive a signal 43 provided by one or more sensors 42. Although the controller 26 shown in FIG. 2 includes one input port 31, it should be appreciated that the invention is not limited in this respect, as controllers according to other embodiments of the invention may be designed to have any number of individually identifiable input ports. Additionally, it should be appreciated that the signal 43 may be digital or analog in nature, as the invention is not limited in this respect. In one embodiment, the control circuitry 50 may include one or more analog-to-digital converters (not shown) to convert an analog signal received at one or more input ports 31 to a corresponding digital signal. One or more such digital signals subsequently may be processed by the microprocessor 46 and encoded as data (according to any of a variety of protocols) that may be transmitted throughout the network, wherein the encoded data is identifiable as corresponding to input signals received at one or more particular input ports 31 of the controller 26.

While the controller 26 shown in FIG. 2 includes a two-way data port 32 (i.e., having an input terminal 32A to receive data and an output terminal 32B to transmit data), as well as output ports 30 and an input port 31, it should be appreciated that the invention is not limited to the particular implementation of a controller shown in FIG. 2. For example, according to other embodiments, a controller may include a one-way data port (i.e., having only one of the input terminal 32A and the output terminal 32B and capable of either receiving or transmitting data, respectively), and/or may include only one or more output ports or only one or more input ports.

Figure 3:
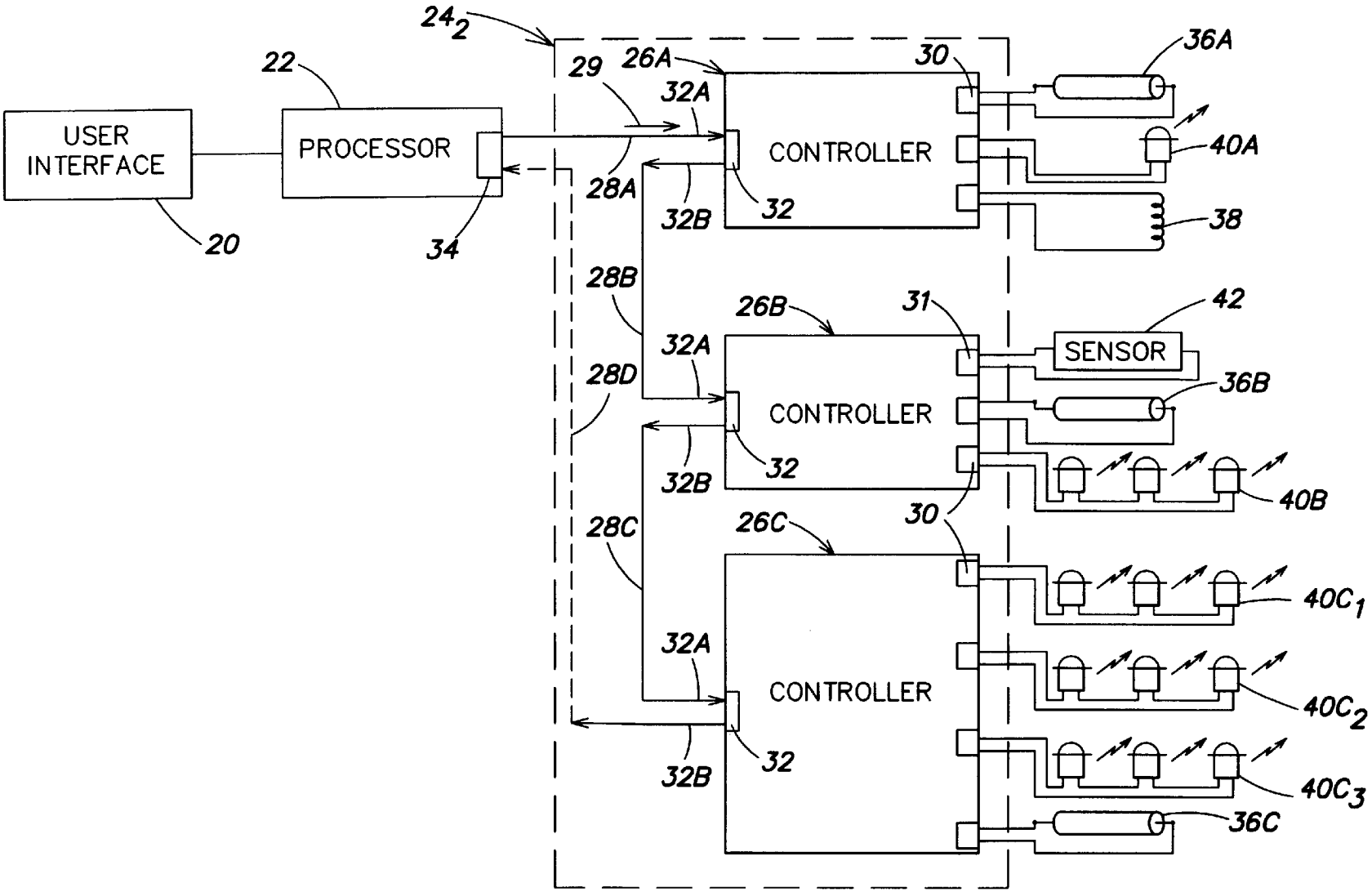
FIG. 3 is a diagram showing a networked lighting system according to another embodiment of the invention.

FIG. 3 is a diagram showing a networked lighting system according to another embodiment of the invention. In the lighting system of FIG. 3, the controllers 26A, 26B, and 26C are series-connected to form a network 24$_2$ having a daisy-chain or ring topology. Although three controllers are illustrated in FIG. 3, it should be appreciated that the invention according to this embodiment is not limited in this respect, as any number of controllers may be series-connected to form the network 24$_2$. Additionally, as discussed above in connection with FIG. 1, networked lighting systems according to various embodiments of the invention may employ any of a number of different addressing schemes and data protocols to transport data. With respect to the networked lighting system shown in FIG. 3, in one aspect, the topology of the network $24_2$ particularly lends itself to data transport techniques based on token ring protocols. However, it should be appreciated that the lighting system of FIG. 3 is not limited in this respect, as other data transport protocols may be employed in this embodiment, as discussed further below.

In the lighting system of FIG. 3, data is transported through the network $24_2$ via a number of data links, indicated as 28A, 28B, 28C, and 28D. For example, according to one embodiment, the controller 26A receives data from the processor 22 on the link 28A and subsequently transmits data to the controller 26B on the link 28B. In turn, the controller 26B transmits data to the controller 26C on the link 28C. As shown in FIG. 3, the controller 26C may in turn optionally transmit data to the processor 22 on the link 28D, thereby forming a ring topology for the network $24_2$. However, according to another embodiment, the network topology of the system shown in FIG. 3 need not form a closed ring (as indicated by the dashed line for the data link 28D), but instead may form an open daisy-chain. For example, in an alternate embodiment based on FIG. 3, data may be transmitted to the network $24_2$ from the processor 22 (e.g., via the data link 28A), but the processor 22 need not necessarily receive any data from the network $24_2$ (e.g., there need not be any physical connection to support the data link 28D).

According to various embodiments based on the system shown in FIG. 3, the data transported on each of the data links 28A–28D may or may not be identical; i.e., stated differently, according to various embodiments, the controllers 26A, 26B, and 26C may or may not receive the same data. Additionally, as discussed above in connection with the system illustrated in FIG. 1, it should be appreciated generally that the particular types and configuration of various devices coupled to the controllers 26A, 26B, and 26C shown in FIG. 3 is for purposes of illustration only. For example, according to other embodiments, a given controller may be associated with only one device, another controller may be associated with only output devices (e.g., one or more light sources or actuators), another controller may be associated with only input devices (e.g., one or more sensors), and another controller may be associated with any number of either input or output devices, or combinations of input and output devices. Additionally, different implementations of a networked lighting system based on the topology shown in FIG. 3 may include only light sources, light sources and other output devices, light sources and sensors, or any combination of light sources, other output devices, and sensors.

Figure 4:
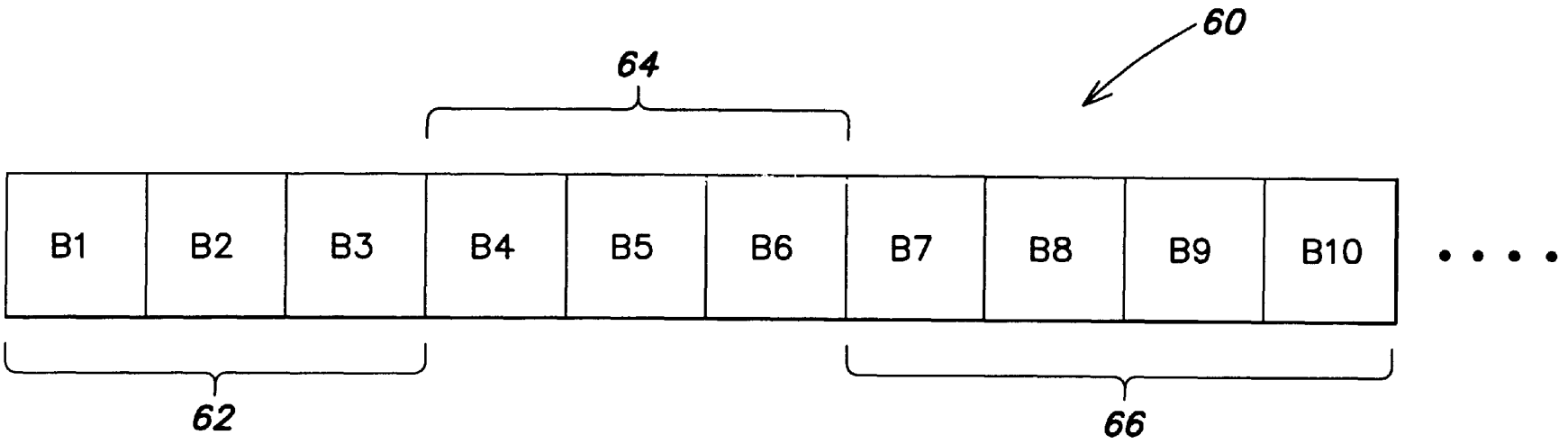
FIG. 4 is a diagram illustrating one example of a data protocol that may be used in the networked lighting system of FIG. 3, according to one embodiment of the invention.

According to one embodiment of the invention based on the network topology illustrated in FIG. 3, data transmitted from the processor 22 to the network $24_2$ (and optionally received by the processor from the network) may be particularly arranged based on the relative position of the controllers in the series connection forming the network $24_2$. For example, FIG. 4 is a diagram illustrating a data protocol based on a particular arrangement of data that may be used in the networked lighting system of FIG. 3, according to one embodiment of the invention. In FIG. 4, a sequence 60 of data bytes B1–B10 is illustrated, wherein the bytes B1–B3 constitute a first portion 62 of the sequence 60, the bytes B4–B6 constitute a second portion 64 of the sequence 60, and the bytes B7–B10 constitute a third portion 66 of the sequence 60. While FIG. 4 shows a sequence of ten data bytes arranged in three portions, it should be appreciated that the invention is not limited in this respect, and that the particular arrangement and number of data bytes shown in FIG. 4 is for purposes of illustration only.

According to one embodiment, the exemplary protocol shown in FIG. 4 may be used in the network lighting system of FIG. 3 to control various output devices (e.g., a number of light sources and/or actuators) coupled to one or more of the controllers 26A, 26B, 26C. For purposes of explaining this embodiment, the sensor 42 coupled to an input port 31 of the controller 26B shown in FIG. 3 is replaced by a light source coupled to an output port 30; namely, the controller 26B is deemed to have three independently controllable output ports 30 respectively coupled to three light sources, rather than two output ports 30 and one input port 31. In this embodiment, each of the data bytes B1–B10 shown in FIG. 4 corresponds to a digital value representing a corresponding desired parameter for a control signal provided by a particular output port of one of the controllers 26A, 26B, and 26C.

In particular, according to one embodiment of the invention employing the network topology of FIG. 3 and the data protocol shown in FIG. 4, the data sequence 60 initially is transmitted from the processor 22 to the controller 26A via the data link 28A, and the data bytes B1–B10 are particularly arranged in the sequence based on the relative position of the controllers in the series connection forming the network $24_2$. For example, the data bytes B1–B3 of the first portion 62 of the data sequence 60 respectively correspond to data intended for the three output ports 30 of the controller 26A. Similarly, the data bytes B4–B6 of the second portion 64 of the sequence respectively correspond to data intended for the three output ports 30 of the controller 26B. Likewise, the data bytes B7–B10 of the third portion 66 of the sequence respectively correspond to data intended for the four output ports 30 of the controller 26C.

In this embodiment, each controller 26A, 26B, and 26C is programmed to receive data via the input terminal 32A of the data port 32, "strip off" an initial portion of the received data based on the number of output ports supported by the controller, and then transmit the remainder of the received data, if any, via the output terminal 32B of the data port 32. Accordingly, in this embodiment, the controller 26A receives the data sequence 60 from the processor 22 via the data link 28A, strips off the first portion 62 of the three bytes B1–B3 from the sequence 60, and uses this portion of the data to control its three output ports. The controller 26A then transmits the remainder of the data sequence, including the second and third portions 64 and 66, respectively, to the controller 26B via the data link 28B. Subsequently, the controller 26B strips off the second portion 62 of the three bytes B4–B6 from the sequence (because these now constitute the initial portion of the data sequence received by the controller 26B), and uses this portion of the data to control its three output ports. The controller 26B then transmits the remainder of the data sequence (now including only the third portion 66) to the controller 26C via the data link 28C. Finally, the controller 26C strips off the third portion 66 (because this portion now constitutes the initial and only portion of the data sequence received by the controller 26C), and uses this portion of the data to control its four output ports.

While the particular configuration of the networked lighting system illustrated in FIG. 3 includes a total of ten output ports (three output ports for each of the controllers 26A and 26B, and four output ports for the controller 26C), and the data sequence 60 shown in FIG. 4 includes at least ten corresponding data bytes B1–B10, it should be appreciated that the invention is not limited in this respect; namely, as discussed above in connection with FIG. 2, a given controller may be designed to support any number of output ports.

Accordingly, in one aspect of this embodiment, it should be appreciated that the number of output ports supported by each controller and the total number of controllers coupled to form the network $24_2$ dictates the sequential arrangement, grouping, and total number of data bytes of the data sequence 60 shown in FIG. 4.

For example, in one embodiment, each controller is designed identically to support four output ports; accordingly, in this embodiment, a data sequence similar to that shown in FIG. 4 is partitioned into respective portions of at least four bytes each, wherein consecutive four byte portions of the data sequence are designated for consecutive controllers in the series connection. In one aspect of this embodiment, the network may be considered "self-configuring" in that it does not require the specific assignment of addresses to controllers, as the position of controllers relative to one another in the series connection dictates the data each controller responds to from the network. As a result, each controller may be configured similarly (e.g., programmed to strip off an initial four byte portion of a received data sequence), and controllers may be flexibly interchanged on the network or added to the network without requiring a system operator or network administrator to reassign addresses. In particular, a system operator or programmer need only know the relative position of a given controller in the series connection to provide appropriate data to the controller.

According to another embodiment of the invention based on the network topology illustrated in FIG. 3 and the data protocol shown in FIG. 4, one or more of the data bytes of the sequence 60 may correspond to digital values representing corresponding input signals received at particular input ports of one or more controllers. In one aspect of this embodiment, the data sequence 60 may be arranged to include at least one byte for each input port and output port of the controllers coupled together to form the network $24_2$, wherein a particular position of one or more bytes in the sequence 60 corresponds to a particular input or output port. For example, according to one embodiment of the invention in which the sensor 42 is coupled to an input port 31 of the controller 26B as shown in FIG. 3, the byte B4 of the data sequence 60 may correspond to a digital value representing an input signal received at the input port 31 of the controller 26B.

In one aspect of this embodiment, rather than stripping off initial portions of received data as described above in the foregoing embodiment, each controller instead may be programmed to receive and transmit the entire data sequence 60. Upon receiving the entire data sequence 60, each controller also may be programmed to appropriately index into the sequence to extract the data intended for its output ports, or place data into the sequence from its input ports. In this embodiment, so as to transmit data corresponding to one or more input ports to the processor 22 for subsequent processing, the data link 28D is employed to form a closed ring topology for the network $24_2$.

In one aspect of this embodiment employing a closed ring topology, the processor 22 may be programmed to initially transmit a data sequence 60 to the controller 26A having "blank" bytes (e.g., null data) in positions corresponding to one or more input ports of one or more controllers of the network $24_2$. As the data sequence 60 travels through the network, each controller may place data corresponding to its input ports, if any, appropriately in the sequence. Upon receiving the data sequence via the data link 28D, the processor 22 may be programmed to extract any data corresponding to input ports by similarly indexing appropriately into the sequence.

According to one embodiment of the invention, the data protocol shown in FIG. 4 may be based at least in part on the DMX data protocol. The DMX data protocol is discussed, for example, in U.S. Pat. No. 6,016,038, referenced above. Essentially, in the DMX protocol, each byte B1–B10 of the data sequence 60 shown in FIG. 4 corresponds to a digital value in a range of 0–255. As discussed above, this digital value may represent a desired output value for a control signal provided by a particular output port of a controller; for example, the digital value may represent an analog voltage level provided by an output port, or a pulse-width of a pulse width modulated signal provided by an output port. Similarly, this digital value may represent some parameter (e.g., a voltage or current value, or a pulse-width) of a signal received at a particular input port of a controller.

According to yet another embodiment of the invention based on the network topology illustrated in FIG. 3 and the data protocol shown in FIG. 4, one or more of the data bytes of the sequence 60 may correspond to an assigned address (or group of addresses) for one or more of the controllers 26A, 26B, and 26C. For example, the byte B1 may correspond to an address (or starting address of a range of addresses) for the controller 26A, the byte B2 may correspond to an address (or starting address of a range of addresses) for the controller 26B, and the byte B3 may correspond to an address (or starting address of a range of addresses) for the controller 26C. The other bytes of the data sequence 60 shown in FIG. 4 respectively may correspond to addresses for other controllers, or may be unused bytes.

In one aspect of this embodiment, the processor 22 transmits at least the bytes B1–B3 to the controller 26A. The controller 26A stores the first byte B1 (e.g., in its memory 48, as shown in FIG. 2) as an address, removes B1 from the data sequence, and transmits the remaining bytes to the controller 26B. In a similar manner, the controller 26B receives the remaining bytes B2 and B3, stores the first received byte (i.e., B2) as an address, and transmits the remaining byte B3 to the controller 26C, which in turn stores the byte B3 (the first received byte) as an address. Hence, in this embodiment, the relative position of each controller in the series connection forming the network $24_2$ dictates the address (or starting address of a range of addresses) assigned to the controller initially by the processor, rather than the data itself to be processed by the controller.

In this embodiment, as in one aspect of the system of FIG. 1 discussed above, once each controller is assigned a particular address or range of addresses, each controller may be programmed to receive and re-transmit all of the data initially transmitted by the processor 22 on the data link 28A; stated differently, in one aspect of this embodiment, once each controller is assigned an address, the sequence of data transmitted by the processor 22 is not constrained by the particular topology (i.e., position in the series connection) of the controllers that form the network $24_2$. Additionally, each controller does not need to be programmed to appropriately index into a data sequence to extract data from, or place data into, the sequence. Rather, data corresponding to particular input and output ports of one or more controllers may be formatted with an "address header" that specifies a particular controller, and a particular input or output port of the controller.

According to another aspect of this embodiment, during the assignment of addresses to controllers, the processor 22 may transmit a data sequence having an arbitrary predetermined number of data bytes corresponding to controller addresses to be assigned. As discussed above, each controller in the series connection in turn extracts an address from the sequence and passes on the remainder of the sequence. Once the last controller in the series connection extracts an address, any remaining addresses in the sequence may be returned to the processor 22 via the data link 28D. In this manner, based on the number of bytes in the sequence originally transmitted by the processor 22 and the number of bytes in the sequence ultimately received back by the processor, the processor may determine the number of controllers that are physically coupled together to form the network $\mathbf{24}_2$.

According to yet another aspect of this embodiment, during the assignment of addresses to controllers, the processor 22 shown in FIG. 3 may transmit an initial controller address to the controller 26A, using one or more bytes of the data sequence 60 shown in FIG. 4. Upon receiving this initial controller address, the controller 26A may store this address (e.g., in nonvolatile memory), increment the address, and transmit the incremented address to the controller 26B. The controller 26B in turn repeats this procedure; namely, storing the received address, incrementing the received address, and transmitting the incremented address to the next controller in the series connection (i.e., the controller 26C). According to one embodiment, the last controller in the series connection (e.g., the controller 26C in the example shown in FIG. 3) transmits either the address it stored or an address that is incremented from the one it stored to the processor 22 (e.g., via the data link 28D in FIG. 3). In this manner, the processor 22 need only transmit to the network an initial controller address, and based on the address it receives back from the network, the processor may determine the number of controllers that are physically coupled together to form the network $\mathbf{24}_2$.

In the various embodiments of the invention discussed above, the processor 22 and the controllers (e.g., 26, 26A, 26B, etc.) can be implemented in numerous ways, such as with dedicated hardware, or using one or more microprocessors that are programmed using software (e.g., microcode) to perform the various functions discussed above. In this respect, it should be appreciated that one implementation of the present invention comprises one or more computer readable media (e.g., volatile and non-volatile computer memory such as PROMs, EPROMs, and EEPROMs, floppy disks, compact disks, optical disks, magnetic tape, etc.) encoded with one or more computer programs that, when executed on one or more processors and/or controllers, perform at least some of the above-discussed functions of the present invention. The one or more computer readable media may be fixed within a processor or controller or may be transportable, such that the one or more programs stored thereon can be loaded into a processor or controller so as to implement various aspects of the present invention discussed above. The term "computer program" is used herein in a generic sense to refer to any type of computer code (e.g., software or microcode) that can be employed to program one or more microprocessors so as to implement the above-discussed aspects of the present invention.

As used herein for purposes of the present disclosure, the term "LED" should be understood to include light emitting diodes of all types (including semi-conductor and organic light emitting diodes), semiconductor dies that produce light in response to current, light emitting polymers, electro-luminescent strips, and the like. Furthermore, the term "LED" may refer to a single light emitting device having multiple semiconductor dies that are individually controlled. It should also be understood that the term "LED" does not restrict the package type of an LED; for example, the term "LED" may refer to packaged LEDs, non-packaged LEDs, surface mount LEDs, chip-on-board LEDs, and LEDs of all other configurations. The term "LED" also includes LEDs packaged or associated with phosphor, wherein the phosphor may convert radiant energy emitted from the LED to a different wavelength.

Additionally, as used herein, the term "light source" should be understood to include all illumination sources, including, but not limited to, LED-based sources as defined above, incandescent sources (e.g., filament lamps, halogen lamps), pyro-luminescent sources (e.g., flames), candle-luminescent sources (e.g., gas mantles), carbon arc radiation sources, photo-luminescent sources (e.g., gaseous discharge sources), fluorescent sources, phosphorescent sources, high-intensity discharge sources (e.g., sodium vapor, mercury vapor, and metal halide lamps), lasers, electro-luminescent sources, cathode luminescent sources using electronic satiation, galvano-luminescent sources, crystallo-luminescent sources, kine-luminescent sources, thermo-luminescent sources, triboluminescent sources, sonoluminescent sources, radioluminescent sources, and luminescent polymers capable of producing primary colors.

Furthermore, as used herein, the term "color" should be understood to refer to any frequency (or wavelength) of radiation within a spectrum; namely, "color" refers to frequencies (or wavelengths) not only in the visible spectrum, but also frequencies (or wavelengths) in the infrared, ultraviolet, and other areas of the electromagnetic spectrum.

Having thus described several illustrative embodiments of the invention, various alterations, modifications, and improvements will readily occur to those skilled in the art. Such alterations, modifications, and improvements are intended to be within the spirit and scope of the invention. Accordingly, the foregoing description is by way of example only, and is not intended as limiting. The invention is limited only as defined in the following claims and the equivalents thereto.

What is claimed is:

1. A method, comprising acts of:

A) transmitting data to an independently addressable controller coupled to at least one LED light source and at least one other controllable device, the data including at least one of first control information for a first control signal output by the controller to the at least one LED light source and second control information for a second control signal output by the controller to the at least one other controllable device; and B) controlling at least one of the at least one LED light source and the at least one other controllable device based on the data, wherein the independently addressable controller includes at least a first output port to output the first control signal, wherein the first control information includes at least a first identifier for the first output port, and wherein the act A) includes an act of:

transmitting at least the first identifier for the first output port to the independently addressable controller, and wherein the first control information includes the first identifier for the first output port and a desired parameter of the first control signal, and wherein the act B) includes acts of:

B1) decoding the data based at least on the first identifier for the first output port to obtain the desired parameter of the first control signal; and B2) outputting the first control signal based on the desired parameter of the first control signal.

2. The method of claim 1, wherein the data further includes at least one address for the independently addressable controller, and wherein the act B) includes acts of:

selecting at least one of the first control information and the second control information based on the at least one address of the independently addressable controller; and controlling at least one of the at least one LED light source and the at least one other controllable device based on the selected at least one of the first control information and the second control information.

3. The method of claim 1, wherein the at least one other controllable device includes at least one incandescent light source.

4. The method of claim 1, wherein the at least one other controllable device includes at least one actuator.

5. The method of claim 1, wherein the first control signal includes a pulse width modulated signal, and wherein the act B2) includes an act of:

selecting a pulse width of the pulse width modulated signal based on the desired parameter of the first control signal.

6. The method of claim 1, wherein the first control signal includes a variable analog voltage signal, and wherein the act B2) includes an act of:

selecting a voltage of the variable analog voltage signal based on the desired parameter of the first control signal.

7. The method of claim 1, wherein the independently addressable controller includes a second output port to output the second control signal, wherein the second control information includes at least a second identifier of the second output port, and wherein the act A) includes an act of:

transmitting at least the second identifier for the second output port to the independently addressable controller.

8. The method of claim 7, wherein the second control information includes the second identifier for the second output port and a desired parameter of the second control signal, and wherein the act B) further includes acts of:

B3) decoding the data based at least on the second identifier of the second output port to obtain the desired parameter of the second control signal; and B4) outputting the second control signal based on the desired parameter of the second control signal.

9. The method of claim 8, wherein the second control signal includes a pulse width modulated signal, and wherein the act B4) includes an act of:

selecting a pulse width of the pulse width modulated signal based on the desired parameter of the second control signal.

10. The method of claim 1, wherein the second control signal includes a variable analog voltage signal, and wherein the act B4) includes an act of:

selecting a voltage of the variable analog voltage signal based on the desired parameter of the second control signal.

11. The method of claim 1, wherein the at least one other controllable device includes at least one fluorescent light source.

12. The method of claim 1, wherein the independently addressable controller includes at least one input port to receive an input signal, and wherein the method further includes acts of:

C) encoding the input signal to provide input data; and

D) transmitting the input data from the independently addressable controller.

13. The method of claim 12, wherein the at least one input port has an input port identifier, and wherein the act C) includes an act of:

encoding the input signal such that the input data is identifiable by the input port identifier.

14. The method of claim 12, further including acts of:

E) receiving the input data transmitted from the independently addressable controller; and F) transmitting second data to the independently addressable controller based on the input data, the second data including at least one of third control information for the first control signal based on the input data and fourth control information for the second control signal based on the input data.

15. A method, comprising acts of:

A) transmitting data to an independently addressable controller coupled to at least one LED light source and at least one other controllable device, the data including at least one of first control information for a first control signal output by the controller to the at least one LED light source and second control information for a second control signal output by the controller to the at least one other controllable device; and B) controlling at least one of the at least one LED light source and the at least one other controllable device based on the data, wherein the independently addressable controller includes at least a first output port to output the first control signal and a second output port to output the second control signal, wherein the data corresponds to a desired parameter of the first control signal and a desired parameter of the second control signal, wherein the data is arranged in a particular sequence based on a configuration of the first and second output ports in the independently addressable controller, and wherein the act B) includes acts of:

B1) decoding the data based on the particular sequence to obtain the desired parameters of the first and second control signals, respectively; and B2) outputting the first and second control signals based on the desired parameters.

16. The method of claim 15, wherein the independently addressable controller includes at least one input port to receive an input signal, and wherein the method further includes acts of:

C) encoding the input signal to provide input data; and

D) transmitting the input data from the independently addressable controller.

17. The method of claim 16, further including acts of:

E) receiving the input data transmitted from the independently addressable controller; and F) transmitting second data to the independently addressable controller based on the input data, the second data including at least one of third control information for the first control signal based on the input data and fourth control information for the second control signal based on the input data.

18. The method of claim 16, wherein the at least one input port has an input port identifier, and wherein the act C) includes an act of:

encoding the input signal such that the input data is identifiable by the input port identifier.

19. The method of claim 15, wherein the at least one other controllable device includes at least one incandescent light source.

20. The method of claim 15, wherein the at least one other controllable device includes at least one actuator.

21. The method of claim 15, wherein the act B1) further includes an act of:

routing the desired parameters of the first and second control signals to the first and second output ports, respectively, based on the configuration of the first and second output ports in the independently addressable controller.

22. The method of claim 15, wherein at least the first control signal includes a first pulse width modulated signal, and wherein the act B1) includes an act of:

selecting a pulse width of the first pulse width modulated signal based on the desired parameter of the first control signal.

23. The method of claim 15, wherein at least the first control signal includes a first variable analog voltage signal, and wherein the act B1) includes an act of:

selecting a voltage of the first variable analog voltage signal based on the desired parameter of the first control signal.

24. The method of claim 15, wherein the at least one other controllable device includes at least one fluorescent light source.

25. A method, comprising acts of:

A) receiving data for a plurality of independently addressable controllers, at least one independently addressable controller of the plurality of independently addressable controllers coupled to at least one LED light source and at least one other controllable device;

B) selecting at least a portion of the data corresponding to at least one of first control information for a first control signal output by the at least one independently addressable controller to the at least one LED light source and second control information for a second control signal output by the at least one independently addressable controller to the at least one other controllable device; and C) controlling at least one of the at least one LED light source and the at least one other controllable device based on the selected portion of the data.

26. The method of claim 25, wherein the data further includes at least one address for the at least one independently addressable controller, and wherein the act B) includes acts of:

selecting at least the portion of the data based on the at least one address of the at least one independently addressable controller.

27. The method of claim 25, wherein the at least one independently addressable controller includes at least a first output port to output the first control signal, wherein the first control information includes at least a desired parameter of the first control signal, and wherein the act C) includes an act of C1) outputting the first control signal based on the desired parameter of the first control signal.

28. The method of claim 27, wherein the first control signal includes a pulse width modulated signal, and wherein the act C1) includes an act of:

selecting a pulse width of the pulse width modulated signal based on the desired parameter of the first control signal.

29. The method of claim 27, wherein the first control signal includes a variable analog voltage signal, and wherein the act C1) includes an act of:

selecting a voltage of the variable analog voltage signal based on the desired parameter of the first control signal.

30. The method of claim 27, wherein the at least one independently addressable controller includes a second output port to output the second control signal, wherein the second control information includes at least a desired parameter of the second control signal, and wherein the act C) further includes an act of:

C2) outputting the second control signal based on the desired parameter of the second control signal.

31. The method of claim 30, wherein the second control signal includes a pulse width modulated signal, and wherein the act C2) includes an act of:

selecting a pulse width of the pulse width modulated signal based on the desired parameter of the second control signal.

32. The method of claim 30, wherein the second control signal includes a variable analog voltage signal, and wherein the act C2) includes an act of:

selecting a voltage of the variable analog voltage signal based on the desired parameter of the second control signal.

33. The method of claim 30, wherein the act C) includes an act of:

routing the desired parameter of the first control signal and the desired parameter of the second control signal to the first and second output ports, respectively, based on a configuration of the first and second output ports in the independently addressable controller.

34. The method of claim 25, wherein the at least one independently addressable controller includes at least one input port to receive an input signal, and wherein the method further includes acts of:

D) encoding the input signal to provide input data; and

E) transmitting the input data from the at least one independently addressable controller.

35. The method of claim 34, wherein the at least one input port has an input port identifier, and wherein the act D) includes an act of:

encoding the input signal such that the input data is identifiable by the input port identifier.

36. The method of claim 25, wherein the at least one other controllable device includes at least one fluorescent light source.

37. The method of claim 25, wherein the at least one other controllable device includes at least one incandescent light source.

38. The method of claim 25, wherein the at least one other controllable device includes at least one actuator.

39. The method of claim 25, wherein:

the at least one LED light source includes at least one red LED light source, at least one green LED light source, and at least one blue LED light source;

the first control signal is output by the at least one independently addressable controller to the at least one red LED light source;

the at least one independently addressable controller outputs a third control signal to the at least one green LED light source and outputs a fourth control signal to the at least one blue LED light source;

the data includes third control information for the third control signal and fourth control information for the fourth control signal; and the act C) includes an act of:

controlling the at least one red LED light source, the at least one green LED light source, the at least one blue LED light source, and the at least one other controllable device based on the data.

40. The method of claim 39, wherein the at least one other controllable device includes at least one fluorescent light source.

41. The method of claim 39, wherein the at least one other controllable device includes at least one incandescent light source.

42. The method of claim 39, wherein the at least one other controllable device includes at least one actuator.

43. A lighting system, comprising:

a plurality of independently addressable controllers coupled together to form a network, at least one independently addressable controller of the plurality of independently addressable controllers coupled to at least one LED light source and at least one other controllable device; and at least one processor coupled to the network and programmed to transmit data to the plurality of independently addressable controllers, the data corresponding to at least one of first control information for a first control signal output by the at least one independently addressable controller to the at least one LED light source and second control information for a second control signal output by the at least one independently addressable controller to the at least one other controllable device, wherein:

the at least one LED light source includes at least one red LED light source, at least one green LED light source, and at least one blue LED light source;

the first control signal is output by the at least one independently addressable controller to the at least one red LED light source;

the at least one independently addressable controller outputs a third control signal to the at least one green LED light source and outputs a fourth control signal to the at least one blue LED light source;

the data includes third control information for the third control signal and fourth control information for the fourth control signal; and the independently addressable controller controls the at least one red LED light source, the at least one green LED light source, the at least one blue LED light source, and the at least one other controllable device based on the data.

44. The lighting system of claim 43, wherein the data further includes at least one address for the at least one independently addressable controller, and wherein the at least one independently addressable controller includes:

a microprocessor to select at least one of the first control information and the second control information based on the at least one address of the independently addressable controller; and control circuitry, coupled to the microprocessor, to output the first and second control signals so as to control at least one of the at least one LED light source and the at least one other controllable device based on the selected at least one of the first control information and the second control information.

45. The lighting system of claim 44, wherein the first control information includes at least a desired parameter of the first control signal, and wherein the control circuitry outputs the first control signal based on the desired parameter of the first control signal.

46. The lighting system of claim 45, wherein the first control signal includes a pulse width modulated signal, and wherein the control circuitry controls a pulse width of the pulse width modulated signal based on the desired parameter of the first control signal.

47. The lighting system of claim 45, wherein the first control signal includes a variable analog voltage signal, and wherein the control circuitry controls a voltage of the variable analog voltage signal based on the desired parameter of the first control signal.

48. The lighting system of claim 45, wherein the second control information includes at least a desired parameter of the second control signal, and wherein the control circuitry outputs the second control signal based on the desired parameter of the second control signal.

49. The lighting system of claim 48, wherein the second control signal includes a pulse width modulated signal, and wherein the control circuitry controls a pulse width of the pulse width modulated signal based on the desired parameter of the second control signal.

50. The lighting system of claim 48, wherein the second control signal includes a variable analog voltage signal, and wherein the control circuitry controls a voltage of the variable analog voltage signal based on the desired parameter of the second control signal.

51. The lighting system of claim 48, wherein the control circuitry routes the desired parameters of the first and second control signals to the first and second output ports, respectively, based on a configuration of the first and second output ports in the at least one independently addressable controller.

52. The lighting system of claim 43, wherein the at least one independently addressable controller includes at least one input port to receive an input signal, and wherein the at least one independently addressable controller encodes the input signal to provide input data and transmits the input data from the independently addressable controller to the network.

53. The lighting system of claim 52, wherein the at least one input port has an input port identifier, and wherein the at least one independently addressable controller encodes the input signal such that the input data is identifiable by the input port identifier.

54. The lighting system of claim 52, wherein the at least one processor receives the input data transmitted from the independently addressable controller and in response transmits second data to the independently addressable controller based on the input data, the second data including at least one of third control information for the first control signal based on the input data and fourth control information for the second control signal based on the input data.

55. The lighting system of claim 48, wherein the at least one other controllable device includes at least one fluorescent light source.

56. The lighting system of claim 48, wherein the at least one other controllable device includes at least one incandescent light source.

57. The lighting system of claim 48, wherein the at least one other controllable device includes at least one actuator.

58. The lighting system of claim 43, wherein the at least one other controllable device includes at least one fluorescent light source.

59. The lighting system of claim 43, wherein the at least one other controllable device includes at least one actuator.

60. The lighting system of claim 43, wherein the at least one other controllable device includes at least one incandescent light source.

61. A method, comprising acts of:

A) transmitting data to an independently addressable controller coupled to at least one LED light source and at least one other controllable device, the data including at least one of first control information for a first control signal output by the controller to the at least one LED light source and second control information for a second control signal output by the controller to the at least one other controllable device; and B) controlling at least one of the at least one LED light source and the at least one other controllable device based on the data, wherein:

the at least one LED light source includes at least one red LED light source, at least one green LED light source, and at least one blue LED light source;

the first control signal is output by the controller to the at least one red LED light source;

the controller outputs a third control signal to the at least one green LED light source and outputs a fourth control signal to the at least one blue LED light source;

the data includes third control information for the third control signal and fourth control information for the fourth control signal; and the act B) includes an act of:

controlling the at least one red LED light source, the at least one green LED light source, the at least one blue LED light source, and the at least one other controllable device based on the data.

62. The method of claim 61, wherein the at least one other controllable device includes at least one fluorescent light source.

63. The method of claim 61, wherein the at least one other controllable device includes at least one incandescent light source.

64. The method of claim 61, wherein the at least one other controllable device includes at least one actuator.

65. In a lighting system including at least first and second independently addressable devices coupled to form a series connection, at least one device of the independently addressable devices including at least one light source, a method comprising an act of:

A) transmitting data to at least the first and second independently addressable devices, the data including control information for at least one of the first and second independently addressable devices, the data being arranged based on a relative position in the series connection of at least the first and second independently addressable devices.

66. The method of claim 65, wherein the control information corresponds to at least one desired parameter associated with at least one of the first and second independently addressable devices.

67. The method of claim 65, wherein at least one of the first and second independently addressable devices includes at least one LED light source.

68. The method of claim 67, wherein the at least one LED light source is adapted to output at least first radiation having a first wavelength and second radiation having a second wavelength, and wherein the act A) includes an act of:

A1) transmitting the data to the at least one LED light source so as to independently control at least a first intensity of the first radiation and a second intensity of the second radiation.

69. The method of claim 68, wherein the act A1) includes an act of: transmitting the data to independently control at least the first intensity of the first radiation and the second intensity of the second radiation so as to vary a perceived color of radiation generated by the at least one LED light source.

70. The method of claim 68, wherein the at least one LED light source includes at least a first LED to output the first radiation and a second LED to output the second radiation.

71. The method of claim 70, wherein the at least one LED light source includes at least one red LED, at least one green LED, and at least one blue LED.

72. The method of claim 67, wherein the at least one of the first and second independently addressable devices includes at least one non-LED light source in addition to the at least one LED light source, and wherein the act A) includes an act of:

transmitting the data to the at least one of the first and second independently addressable devices so as to independently control the at least one LED light source and the at least one non-LED light source.

73. The method of claim 67, wherein the first independently addressable device includes at least one first LED light source, wherein the second independently addressable device includes at least one second LED light source, and wherein the act A) includes an act of:

transmitting the data to the at least one first LED light source and the at least one second LED light source so as to independently control the at least one first LED light source and the at least one second LED light source.

74. The method of claim 67, wherein the first independently addressable device includes at least one LED light source, wherein the second independently addressable device includes at least one non-LED light source, and wherein the act A) includes an act of:

transmitting the data to the at least one LED light source and the at least one non-LED light source so as to independently control the at least one LED light source and the at least one non-LED light source.

75. The method of claim 65, wherein the control information includes at least one address for at least one of the first and second independently addressable devices.

76. The method of claim 66, wherein the control information includes at least one modulated signal, and wherein the method further includes an act of:

setting a modulation parameter of the at least one modulated signal based on the at least one desired parameter.

77. The method of claim 76, wherein the control information includes at least one pulse width modulated signal, and wherein the method further includes an act of:

setting a pulse width of the at least one pulse width modulated signal based on the at least one desired parameter.

78. The method of claim 66, wherein the control information includes at least one variable analog voltage signal, and wherein the method further includes an act of:

setting a voltage of the at least one variable analog voltage signal based on the at least one desired parameter.

79. The method of claim 65, further comprising an act of:

decoding the data at at least one of the first and second independently addressable devices based on the relative position in the series connection of at least the first and second independently addressable devices.

80. The method of claim 65, wherein at least one of the first and second independently addressable devices includes at least one fluorescent light source, wherein the control information corresponds to at least one desired parameter associated with the at least one fluorescent light source, and wherein the act A) includes an act of:

transmitting the data in the at least one fluorescent light source, the data being arranged based on the relative position in the series connection of the at least one fluorescent light source.

81. The method of claim 65, wherein at least one of the first and second independently addressable devices includes at least one incandescent light source, wherein the control information corresponds to at least one desired parameter associated with the at least one incandescent light source, and wherein the act A) includes an act of:

transmitting the data to the at least one incandescent light source, the data being arranged based on the relative position in the series connection of the at least one incandescent light source.

82. An apparatus for use in a lighting system including at least first and second independently addressable devices coupled to form a series connection, at least one device of the independently addressable devices including at least one light source, the apparatus comprising:

at least one processor having an output to couple the at least one processor to the first and second independently addressable devices, the at least one processor programmed to transmit data to at least the first and second independently addressable devices, the data including control information for at least one of the first and second independently addressable devices, the data arranged based on a relative position in the series connection of at least the first and second independently addressable devices.

83. In a lighting system including at least first and second independently addressable devices, at least one device of the independently addressable devices including at least one light source, a method comprising acts of:

A) receiving at the first independently addressable device first data for at least the first and second independently addressable devices;

B) removing at least a first data portion from the first data to form second data, the first data portion corresponding to first control information for the first independently addressable device; and C) transmitting from the first independently addressable device the second data.

84. The method of claim 83, wherein the data includes at least one address for at least one of the first and second independently addressable devices.

85. The method of claim 83, wherein at least one of the first and second independently addressable devices includes at least one LED light source.

86. The method of claim 85, wherein the first independently addressable device includes at least one first LED light source, wherein the second independently addressable device includes at least one second LED light source, and wherein the method further includes acts of:

controlling the at least one first LED light source based on the first data portion; and controlling the at least one second LED light source based on at least a portion of the second data.

87. The method of claim 85, wherein the first independently addressable device includes at least one LED light source, wherein the second independently addressable device includes at least one non-LED light source, and wherein the method further includes acts of:

controlling the at least one LED light source based on the first data portion; and controlling the at least one non-LED light source based on at least a portion of the second data.

88. The method of claim 83, wherein the first control information corresponds to at least one desired parameter associated with the first independently addressable device.

89. The method of claim 88, wherein the first control information includes at least one modulated signal having a modulation parameter based on the at least one desired parameter associated with the first independently addressable device.

90. The method of claim 89, wherein the first control information includes at least one pulse width modulated signal having a pulse width based on the at least one desired parameter associated with the first independently addressable device.

91. The method of claim 88, wherein the first control information includes at least one variable analog voltage signal having a voltage based on the at least one desired parameter associated with the first independently addressable device.

92. The method of claim 88, further comprising acts of:

D) decoding the first data portion to recover the first control information; and E) controlling the first independently addressable device based on the recovered first control information.

93. The method of claim 92, wherein the first independently addressable device includes at least one fluorescent light source, wherein the first control information corresponds to at least one desired parameter associated with the at least one fluorescent light source, and wherein the act E) includes an act of:

controlling the at least one fluorescent light source based on the recovered first control information.

94. The method of claim 92, wherein the first independently addressable device includes at least one incandescent light source, wherein the first control information corresponds to at least one desired parameter associated with the at least one incandescent light source, and wherein the act E) includes an act of:

controlling the at least one incandescent light source based on the recovered first control information.

95. The method of claim 92, wherein the first independently addressable device includes at least one LED light source, wherein the first control information corresponds to at least one desired parameter associated with the at least one LED light source, and wherein the act E) includes an act of:

E1) controlling the at least one LED light source based on the recovered first control information.

96. The method of claim 95, wherein the at least one LED light source is adapted to output at least first radiation having a first wavelength and second radiation having a second wavelength, wherein the first control information includes at least first intensity information and second intensity information, and wherein the act E1) includes an act of:

E2) independently controlling at least a first intensity of the first radiation and a second intensity of the second radiation based on the first intensity information and the second intensity information.

97. The method of claim 96, the act E2) includes an act of:

independently controlling at least the first intensity of the first radiation and the second intensity of the second radiation so as to vary a perceived color of radiation generated by the at least one LED light source.

98. The method of claim 96, wherein the at least one LED light source includes at least a first LED to output the first radiation and a second LED to output the second radiation.

99. The method of claim 98, wherein the at least one LED light source includes at least one red LED, at least one green LED, and at least one blue LED.

100. The method of claim 92, wherein the first independently addressable device includes at least one non-LED light source in addition to the at least one LED light source, wherein the first control information corresponds to at least one first desired parameter associated with the at least one non-LED light source and at least one second desired parameter associated with the at least one LED light source, and wherein the act E) includes an act of:

E1) controlling the at least one non-LED light source and the at least one LED light source based on the recovered first control information.

101. A lighting system, comprising:

at least first and second independently addressable devices coupled to form a series connection, at least one device of the independently addressable devices including at least one light source; and at least one processor coupled to the first and second independently addressable devices, the at least one processor programmed to transmit data to at least the first and second independently addressable devices, the data including control information for at least one of the first and second independently addressable devices, the data arranged based on a relative position in the series connection of at least the first and second independently addressable devices.

102. The lighting system of claim 101, wherein the control information includes at least one address for at least one of the first and second independently addressable devices.

103. The lighting system of claim 101, wherein the control information corresponds to at least one desired parameter associated with at least one of the first and second independently addressable devices.

104. The lighting system of claim 103, wherein the control information includes at least one modulated signal having a modulation parameter based on the at least one desired parameter.

105. The lighting system of claim 104, wherein the control information includes at least one pulse width modulated signal having a pulse width based on the at least one desired parameter.

106. The lighting system of claim 103, wherein the control information includes at least one variable analog voltage signal having a voltage based on the at least one desired parameter.

107. The lighting system of claim 101, wherein each of the at least first and second independently addressable devices includes a decoder adapted to decode the data based on the relative position in the series connection of at least the first and second independently addressable devices.

108. The lighting system of claim 101, wherein at least one of the first and second independently addressable devices includes at least one fluorescent light source, and wherein the control information corresponds to at least one desired parameter associated with the at least one fluorescent light source.

109. The lighting system of claim 101, wherein at least one of the first and second independently addressable devices includes at least one incandescent light source, and wherein the control information corresponds to at least one desired parameter associated with the at least one incandescent light source.

110. The lighting system of claim 101, wherein at least one of the first and second independently addressable devices includes at least one LED light source.

111. The lighting system of claim 110, wherein the at least one of the first and second independently addressable devices includes at least one non-LED light source in addition to the at least one LED light source, and wherein the at least one processor is programmed to transmit the data to the at least one of the first and second independently addressable devices so as to independently control the at least one LED light source and the at least one non-LED light source.

112. The lighting system of claim 110, wherein the first independently addressable device includes at least one first LED light source, wherein the second independently addressable device includes at least one second LED light source, and wherein the at least one processor is programmed to transmit the data to the at least one first LED light source and the at least one second LED light source so as to independently control the at least one first LED light source and the at least one second LED light sources.

113. The lighting system of claim 110, wherein the at least one LED light source is adapted to output at least first radiation having a first wavelength and second radiation having a second wavelength, and wherein the at least one processor is programmed to transmit the data to the at least one LED light source so as to independently control at least a first intensity of the first radiation and a second intensity of the second radiation.

114. The lighting system of claim 113, wherein the at least one processor is programmed to independently control at least the first intensity of the first radiation and the second intensity of the second radiation so as to vary a perceived color of radiation generated by the at least one LED light source.

115. The lighting system of claim 113, wherein the at least one LED light source includes at least a first LED to output the first radiation and a second LED to output the second radiation.

116. The lighting system of claim 115, wherein the at least one LED light source includes at least one red LED, at least one green LED, and at least one blue LED.

117. The lighting system of claim 110, wherein the first independently addressable device includes at least one LED light source, wherein the second independently addressable device includes at least one non-LED light source, and wherein the at least one processor is programmed to transmit the data to the at least one LED light source and the at least one non-LED light source so as to independently control the at least one LED light source and the at least one non-LED light source.

118. An apparatus for use in a lighting system including at least first and second independently controllable devices, at least one device of the independently controllable devices including at least one light source, the apparatus comprising:

at least one controller having at least one output port to couple the at least one controller to at least the first independently controllable device and at least one data port to receive first data for at least the first and second independently controllable devices, the at least one controller constructed to remove at least a first data portion from the first data to form second data and to transmit the second data via the at least one data port, the first data portion corresponding to first control information for at least the first independently controllable device.

119. The apparatus of claim 118, wherein the at least one data port includes a receive port and a transmit port, and wherein the at least one controller is configured to receive the first data via the receive port and transmit the second data via the transmit port.

120. The apparatus of claim 118, wherein the at least one controller is further configured to control at least the first independently controllable device based on the first data portion.

121. The apparatus of claim 120, wherein the at least one controller is configured to generate at least one variable analog voltage signal to control at least the first independently controllable device.

122. The apparatus of claim 121, wherein the at least one controller is configured to set a voltage of the at least one variable analog voltage signal based on the first control information.

123. The apparatus of claim 120, wherein the at least one controller is configured to generate at least one modulated signal to control at least the first independently controllable device.

124. The apparatus of claim 123, wherein the at least one controller is configured to generate at least one pulse width modulated signal to control at least the first independently controllable device.

125. The apparatus of claim 124, wherein the at least one controller is configured to set a pulse width of the at least one pulse width modulated signal based on the first control information.

126. The apparatus of claim 118, wherein the at least one output port includes a first output port to couple the at least one controller to the first independently controllable device and a second output port to couple the at least one controller to the second independently controllable device.

127. The apparatus of claim 126, wherein the first data portion corresponds to first control information for the first independently controllable device and second control information for the second independently controllable device.

128. The apparatus of claim 127, wherein the at least one controller is configured to control at least the first and second independently controllable devices based on the first data portion.

129. The apparatus of claim 128, wherein the at least one controller is configured to generate a first pulse width modulated signal to control the first independently controllable device and a second pulse width modulated signal to control the second independently controllable device.

130. The apparatus of claim 129, wherein the at least one controller is configured to select a first pulse width of the first pulse width modulated signal based on the first control information and a second pulse width of the second pulse width modulated signal based on the second control information.

131. The apparatus of claim 128, wherein the at least one controller is configured to generate a first variable analog voltage signal to control the first independently controllable device and a second variable analog voltage signal to control the second independently controllable device.

132. The apparatus of claim 131, wherein the at least one controller is configured to select a first voltage of the first variable analog voltage signal based on the first control information and a second voltage of the second variable analog voltage signal based on the second control information.

133. The apparatus of claim 118, further comprising the first independently controllable device coupled to the at least one output port of the at least one controller, wherein the first independently controllable device includes the at least one light source.

134. The apparatus of claim 133, wherein the at least one light source includes at least one incandescent light source.

135. The apparatus of claim 133, wherein the at least one light source includes at least one LED light source.

136. The apparatus of claim 135, wherein the at least one output port includes a first output port to couple the at least one controller to the at least one LED light source and a second output port to couple the at least one controller to the second independently controllable device.

137. The apparatus of claim 136, further comprising the second independently controllable device coupled to the second output port of the at least one controller.

138. The apparatus of claim 137, wherein the second independently controllable device includes at least one incandescent light source.

139. The apparatus of claim 137, wherein the second independently controllable device includes at least one fluorescent light source.

140. The apparatus of claim 137, the first independently controllable device includes a first LED light source and the second independently controllable device includes a second LED light source.

141. The apparatus of claim 140, wherein the first and second LED light sources are adapted to output at least first radiation having a first wavelength and second radiation having a second wavelength, and wherein the at least one controller is configured to independently control at least a first intensity of the first radiation and a second intensity of the second radiation based on the first data portion.

142. The apparatus of claim 141, wherein the at least one controller is configured to independently control at least the first intensity of the first radiation and the second intensity of the second radiation so as to vary a perceived color of combined radiation generated by the first and second LED light sources.

143. The apparatus of claim 140, wherein the at least one output port includes a third output port to couple the at least one controller to a third independently controllable device.

144. The apparatus of claim 143, further comprising the third independently controllable device coupled to the third output port, wherein the third independently controllable device includes a third light source.

145. The apparatus of claim 144, wherein the at least one controller is configured to independently control at least the first, second, and third light sources based on the first data portion.

146. The apparatus of claim 144, wherein the third light source includes at least one fluorescent light source.

147. The apparatus of claim 144, wherein the third light source includes at least one incandescent light source.

148. The apparatus of claim 144, wherein the third light source includes a third LED light source.

149. The apparatus of claim 148, wherein the first LED light source includes at least one red LED, the second LED light source includes at least one green LED, and the third LED light source includes at least one blue LED.

150. The apparatus of claim 149, wherein the at least one output port includes a fourth output port to couple the at least one controller to a fourth independently controllable device.

151. The apparatus of claim 150, further comprising the fourth independently controllable device coupled to the fourth output port, wherein the fourth independently controllable device includes a fourth light source.

152. The apparatus of claim 150, wherein the fourth light source includes at least one fluorescent light source.

153. The apparatus of claim 150, wherein the fourth light source includes at least one incandescent light source.

154. The apparatus of claim 150, wherein the at least one controller is configured to independently control at least the first, second, third and fourth light sources based on the first data portion.

155. The apparatus of claim 118, wherein at least a portion of the second data corresponds to second control information for at least the second independently controllable device, and wherein the at least one controller is configured to transmit the second data via the at least one data port to the second independently controllable device.

156. The apparatus of claim 133, wherein the at least one light source includes at least one fluorescent light source.

* * * * *

UNITED STATES PATENT AND TRADEMARK OFFICE

CERTIFICATE OF CORRECTION

PATENT NO. : 6,608,453 B2
DATED : August 19, 2003
INVENTOR(S) : Frederick Morgan et al.

It is certified that error appears in the above-identified patent and that said Letters Patent is hereby corrected as shown below:

Title page,
Item [75], Inventors, please replace as follows:

-- Inventors: Frederick Morgan, Quincy, MA (US);
Alfred Ducharme, Tewksbury, MA (US);
Brian Chemel, Salem, MA (US);
Robert Laszewski, Brookline, MA (US);
Kevin Dowling, Westford, MA (US);
Ihor Lys (US) --

Title page,
Item [63], Related U.S. Application Data, please replace as follows:

-- Continuation-in-part of application No. 09/669,121, filed on Sep. 25, 2000, which is a continuation of application No. 09/425,770, filed on Oct. 22, 1999, now Pat. No. 6,150,774, which is a continuation of application No. 08/920,156, filed on Aug. 26, 1997, now Pat. No. 6,016,038. Continuation-in-part of application No. 09/215,624, filed on Dec. 17, 1998, and a continuation-in-part of application No. 09/213,607, filed on Dec. 17, 1998, and a continuation-in-part of application No. 09/213,189, filed on Dec. 17, 1998, and a continuation-in-part of application No. 09/213,581, filed on Dec. 17, 1998, and a continuation-in-part of application No. 09/213,540, filed on Dec. 17, 1998, and a continuation-in-part of application No. 09/333,739, filed on Jun. 15, 1999, and a continuation-in-part of application No. 09/742,017, filed on Dec. 20, 2000, which is a continuation of application No. 09/213,548, filed on Dec. 17, 1998, now Pat. No. 6,166,496, and a continuation-in-part of application No. 09/815,418, filed on Mar. 22, 2001, which is a continuation of application No. 09/213,548. --

Signed and Sealed this

Twenty-fifth Day of May, 2004

JON W. DUDAS
*Acting Director of the United States Patent and Trademark Office*